US011248340B2

(12) United States Patent
Sahiner et al.

(10) Patent No.: US 11,248,340 B2
(45) Date of Patent: Feb. 15, 2022

(54) WIRE, IN PARTICULAR FOR A STRANDED WIRE

(71) Applicant: LEONI KABEL GMBH, Roth (DE)

(72) Inventors: Yücel Sahiner, Nuremberg (DE); Markus Schill, Munich (DE)

(73) Assignee: LEONI KABEL GMBH, Roth (DE)

( * ) Notice: Subject to any disclaimer, the term of this patent is extended or adjusted under 35 U.S.C. 154(b) by 0 days.

(21) Appl. No.: 16/961,964

(22) PCT Filed: Jan. 9, 2019

(86) PCT No.: PCT/EP2019/050392

§ 371 (c)(1),
(2) Date: Jul. 14, 2020

(87) PCT Pub. No.: WO2019/141555

PCT Pub. Date: Jul. 25, 2019

(65) Prior Publication Data

US 2020/0362512 A1 Nov. 19, 2020

(30) Foreign Application Priority Data

Jan. 17, 2018 (EP) ..... 102018200685.7

(51) Int. Cl.

| | |
|---|---|
| ***D07B 1/06*** | (2006.01) |
| ***B21C 1/02*** | (2006.01) |
| *H01B 5/10* | (2006.01) |
| *H01B 13/02* | (2006.01) |

(52) U.S. Cl.

CPC ..... *D07B 1/0693* (2013.01); *B21C 1/02* (2013.01); *D07B 2201/2002* (2013.01); *D07B 2205/306* (2013.01); *D07B 2501/406* (2013.01); *H01B 5/10* (2013.01); *H01B 13/0207* (2013.01)

(58) Field of Classification Search

CPC ..... D07B 1/0646; D07B 1/0693; D07B 2201/1016; D07B 2201/2002; D07B 2201/2016

See application file for complete search history.

(56) References Cited

U.S. PATENT DOCUMENTS

| | | | | |
|---|---|---|---|---|
| 1,996,689 A * | 4/1935 | Rohs | D07B 1/0693 | 57/311 |
| 2,250,907 A | 7/1941 | Edwards | | |
| 2,464,746 A * | 3/1949 | Gering | B29B 9/06 | 264/141 |
| 3,164,948 A * | 1/1965 | Stratford | D01D 5/253 | 57/260 |
| 3,470,685 A * | 10/1969 | Hall | D01D 5/423 | 428/85 |

(Continued)

FOREIGN PATENT DOCUMENTS

| | | |
|---|---|---|
| CN | 201498254 U | 6/2010 |
| CN | 102074283 | 5/2011 |

(Continued)

*Primary Examiner* — Shaun R Hurley

(74) *Attorney, Agent, or Firm* — Tarolli, Sundheim, Covell & Tummnio LLP

(57) ABSTRACT

A wire (10) is disclosed. Said wire (10), when viewed in cross-section, has at least one first portion (12) and at least one second portion (14) that are interconnected by a third portion (16) in which the wire (10) has a reduced cross-section.

3 Claims, 12 Drawing Sheets

(56) References Cited

U.S. PATENT DOCUMENTS 3,667,206 A * 6/1972 Gilmore ..... D07B 1/068 57/215
3,707,839 A * 1/1973 Glushko ..... H01B 7/226 57/9
4,332,761 A * 6/1982 Phillips ..... D01D 5/253 264/103
4,463,219 A 7/1984 Sato
4,514,058 A * 4/1985 Walton ..... G02B 6/4427 385/107
5,006,057 A * 4/1991 Bagrodia ..... D01D 5/253 264/177.13
5,208,106 A * 5/1993 Tung ..... D01D 5/253 428/357
6,147,017 A * 11/2000 Fastenau ..... D01D 5/253 428/392
6,622,766 B1 * 9/2003 Baldwin, Jr. ..... B60C 15/04 152/540
6,967,289 B2 11/2005 Goto
7,479,597 B1 1/2009 Cases et al.
D640,061 S * 6/2011 Wang ..... D5/8
8,632,432 B2 1/2014 Bissig et al.
8,641,944 B2 * 2/2014 Wang ..... D01F 6/46 264/51
D822,394 S * 7/2018 Chin ..... D5/99
2002/0040572 A1 4/2002 Adrian
2004/0149484 A1 8/2004 Clark
2006/0099867 A1 * 5/2006 Schwartz ..... D03D 15/47 442/195
2011/0287210 A1 * 11/2011 Tung ..... D01D 5/24 428/85
2012/0260590 A1 * 10/2012 Lambert ..... D07B 5/002 52/223.13
2019/0284721 A1 * 9/2019 Casey ..... D01D 5/253
2020/0016694 A1 * 1/2020 Cooper ..... B23K 26/1464

FOREIGN PATENT DOCUMENTS

CN 201877153 U 6/2011
CN 202339730 U 7/2012
CN 202443775 U 9/2012
DE 1241087 B 5/1967
DE 4410113 A1 9/1995
FR 1369618 8/1964
JP S5522086 U 2/1980
SU 867974 A1 9/1981

* cited by examiner

WIRE, IN PARTICULAR FOR A STRANDED WIRE

RELATED APPLICATIONS

This application filed under 35 U.S.C § 371 is a national phase application of International Application Number PCT/EP2019/050392, filed Jan. 9, 2019, which claims the benefit of German Application No. 10 2018 200 685.7 filed Jan. 17, 2018, the subject matter of which are incorporated herein by reference in their entirety.

TECHNICAL FIELD

The present invention relates to a wire which can be used in particular in a stranded wire. The present invention relates further to a stranded wire having at least one such wire.

BACKGROUND

Known wires have substantially a round, mostly circular, cross-section. Wires with a round cross-section give rise to some restrictions in the production of a stranded wire s using such wires. Wires with a round or circular cross-section can be processed by means of a stamping machine, with a symmetrical or regular arrangement of the wires and inlays, only to a stranded wire that is hexagonal in cross-section. In the case of an asymmetrical or irregular arrangement of the wires and the inlays, production yields a tapered assembly, that is to say the cross-section of the stranded wire becomes increasingly constricted.

Accordingly, there is a need for a wire with which, inter alia, the above-described restrictions in the production of a stranded wire can be eliminated.

SUMMARY

According to a first aspect, a wire is provided. The wire, when viewed in cross-section, has at least one first portion and at least one second portion which are interconnected by a third portion in which the wire has a reduced cross-section.

The third portion can be arranged between the first portion and the second portion. The third portion can form the central portion of the wire. The first portion, the second portion and the third portion can be formed in one piece.

The wire can have a curved shell surface. The shell surface can be curved in the third portion in the opposite direction to its curve in the first portion and in the second portion. The shell surface can be curved concavely, for example, in the third portion. In the first portion and/or in the second portion, the shell surface can be curved convexly. The shell surface of the wire can have at least one indentation which reduces the cross-section of the wire in the direction of the third portion. The indentation can be curved convexly at least in part in the first and/or in the second portion. There can be provided, for example, two indentations which reduce the cross-section of the wire in the third portion from two directions or from two sides. The two indentations can face one another. The third portion can substantially be in the form of a connecting web between the first portion and the second portion.

The first portion and the second portion, when viewed in cross-section, can be substantially round. The first portion and the second portion can be substantially equal in size. The wire, when viewed in cross-section, can substantially have the shape of an 8 or the shape of a pair of spectacles. The first portion and the second portion can have a substantially circular cross-section at least in part.

According to a second aspect, a stranded wire is provided. The stranded wire has at least one wire with the above-described cross-section. The stranded wire can also have a plurality of wires with the above-described cross-section.

With the wires which have the above-described cross-section, stranded wires that have a round cross-section can be produced.

The wires can be produced from multiple materials. Wires produced from a first material and wires produced from a second material can be used for a stranded wire. The stranded wire can of course also have wires that have been produced from three or more different materials.

The stranded wire can have at least one inlay element. The at least one inlay element can be arranged in a predetermined position in the stranded wire. The at least one inlay element can be arranged centrally in the stranded wire. The at least one inlay element can form the midpoint of the stranded wire. The predetermined position of the at least one inlay element can be different from the above-mentioned position of the inlay element in the midpoint of the stranded wire. The at least one inlay element can be arranged in the stranded wire in such a manner that the stranded wire, in cross-section, has an asymmetrical or irregular structure. The at least one inlay element can have a round cross-section. Furthermore, the at least one inlay element can also have a circular cross-section.

The stranded wire can have at least one wire which is arranged on a radius around the center of the stranded wire. The wires on this radius can, for example, be arranged around at least one inlay element. The inlay element can form the midpoint of the stranded wire and be surrounded by the wires arranged on the radius.

Furthermore, further wires can be arranged between the midpoint of the stranded wire and the wires arranged on the radius. Wires that extend substantially in a radial direction can be provided between the midpoint of the stranded wire and the wires arranged on the radius. Inlay elements can further be arranged between the midpoint of the stranded wire and the wires arranged on the radius. At least one wire that is produced from a different material than the wires on the radius can be arranged between the midpoint of the stranded wire and the wires arranged on the radius. Some of the wires arranged on the radius can further be separated from one another by the inlay elements arranged on the radius.

Each wire can be arranged within the stranded wire in a predetermined position and/or location. Owing to the cross-section of the wires, the wires are able to retain their predetermined position and/or location in the stranded wire during production of the stranded wire.

The wires can be so arranged in the stranded wire that they extend substantially in a radial direction. The stranded wire can have at least two wires extending parallel to one another. The parallel wires can extend in a radial direction and/or obliquely to an inlay element. The stranded wire can have at least one wire whose first portion is arranged on a first radius and whose second portion is arranged on a second radius around the midpoint of the stranded wire. The first radius and the second radius can be different from one another.

The stranded wire can have at least one wire with the above-described cross-section whose first portion and whose second portion is arranged on a radius around the midpoint of the stranded wire. The first portion, the second portion and the third portion of the wire can lie on a common radius around the midpoint of the stranded wire.

The at least one inlay element can be arranged in such a manner that it holds the wires in their predetermined position and/or location. The at least one inlay element can establish a predetermined distance between at least two adjacent portions of two wires. The stranded wire can have a plurality of inlay elements. The inlay elements can be arranged in such a manner that at least some of the wires extend substantially in a radial direction. The inlay elements can be so positioned in the stranded wire that, in cross-section, an irregular structure of the stranded wire is obtained. For example, the inlay elements, when viewed in cross-section, can be arranged only in a part-region of the stranded wire, while no inlay elements are arranged in the remaining part-regions of the cross-section of the stranded wire. One inlay element of the plurality of inlay elements can form the midpoint of the stranded wire. A single inlay element, which forms the midpoint of the stranded wire, can be provided in the stranded wire.

The wires can be so arranged that the stranded wire is hexagonal in cross-section. The wires can be arranged around the midpoint of the stranded wire in multiple layers which are hexagonal in cross-section.

According to a third aspect, a drawing die for producing a wire having the above-described cross-section is provided. The drawing die has an opening. The opening has at least one projection which reduces the cross-section of the opening in at least one portion.

According to a fourth aspect, a production method for a wire having the above-described cross-section is proposed. A wire is drawn through at least one drawing die. The drawing die has an opening which reduces the cross-section of the wire in at least one portion.

Before the wire is drawn through the drawing die having the opening that reduces the cross-section in a portion, the wire can be drawn through at least one further drawing die. For example, the wire can be drawn through a drawing die which has an opening in the form of a slot. With such an opening, the wire can be drawn into a flat or rod-shaped cross-section. Furthermore, at the beginning of the production method, the wire can also be drawn through a drawing die which converts the wire into a round cross-section.

It will be appreciated that the expressions used herein serve merely to describe individual embodiments and are not to be considered limiting. Unless defined otherwise, all technical and scientific expressions used herein have the meaning that corresponds to the general understanding of the person skilled in the art in the relevant field for the present disclosure; they are not to be interpreted either too broadly or too narrowly. If specialist expressions are used inappropriately herein and thus do not express the technical idea of the present disclosure, they are to be replaced by specialist expressions that provide the person skilled in the art with a correct understanding. The general expressions used herein are to be interpreted on the basis of the definition found in the dictionary or according to the context; too narrow an interpretation is to be avoided.

It will here be understood that expressions such as, for example, "comprise" or "have", etc. signify the presence of the described features, numbers, operations, actions, components, parts or combinations thereof and do not exclude the presence, or the possible addition, of one or more further features, numbers, operations, actions, components, parts or combinations thereof.

Although expressions such as "first" or "second", etc. may be used to describe different components, those components are not to be limited to those expressions. The above expressions are merely intended to distinguish one component from the others. For example, a first component may be referred to as a second component without departing from the scope of protection of the present disclosure; likewise, a second component may be referred to as a first component. The expression "and/or" includes both the combination of the plurality of connected objects and each object of that plurality of the described plurality of objects.

If it is stated herein that a component "is connected" to another component, is "associated" therewith or "acts thereon", this may mean that it is connected directly thereto or acts directly thereon; however, it should be noted that a further component may be located therebetween. If, on the other hand, it is stated that a component is "directly connected" to another component or "acts directly thereon", this means that further components are not present therebetween.

Specific embodiments of the present disclosure will be described hereinbelow with reference to the accompanying drawings, in which identical components are always provided with the same reference numerals. In the description of the present disclosure, detailed explanations of known associated functions or constructions are not given if they distract unnecessarily from the meaning of the present disclosure; such functions and constructions are, however, comprehensible to the person skilled in the art. The accompanying drawings of the present disclosure serve to illustrate the present disclosure and are not to be interpreted as limiting. The technical idea of the present disclosure is to be interpreted as including, in addition to the accompanying drawings, also all such modifications, changes and variants.

Further objects, features, advantages and possible applications will become apparent from the following description of exemplary embodiments, which are not to be interpreted as limiting, with reference to the accompanying drawings. All the features that are described and/or depicted in the drawings thereby show the subject-matter disclosed herein on their own or in any desired combination, also independently of their grouping in the claims or their dependencies. The dimensions and proportions of the components shown in the figures are not necessarily to scale; they may differ from those shown here in embodiments that are to be implemented. In the figures:

DETAILED DESCRIPTION

Figure 1:
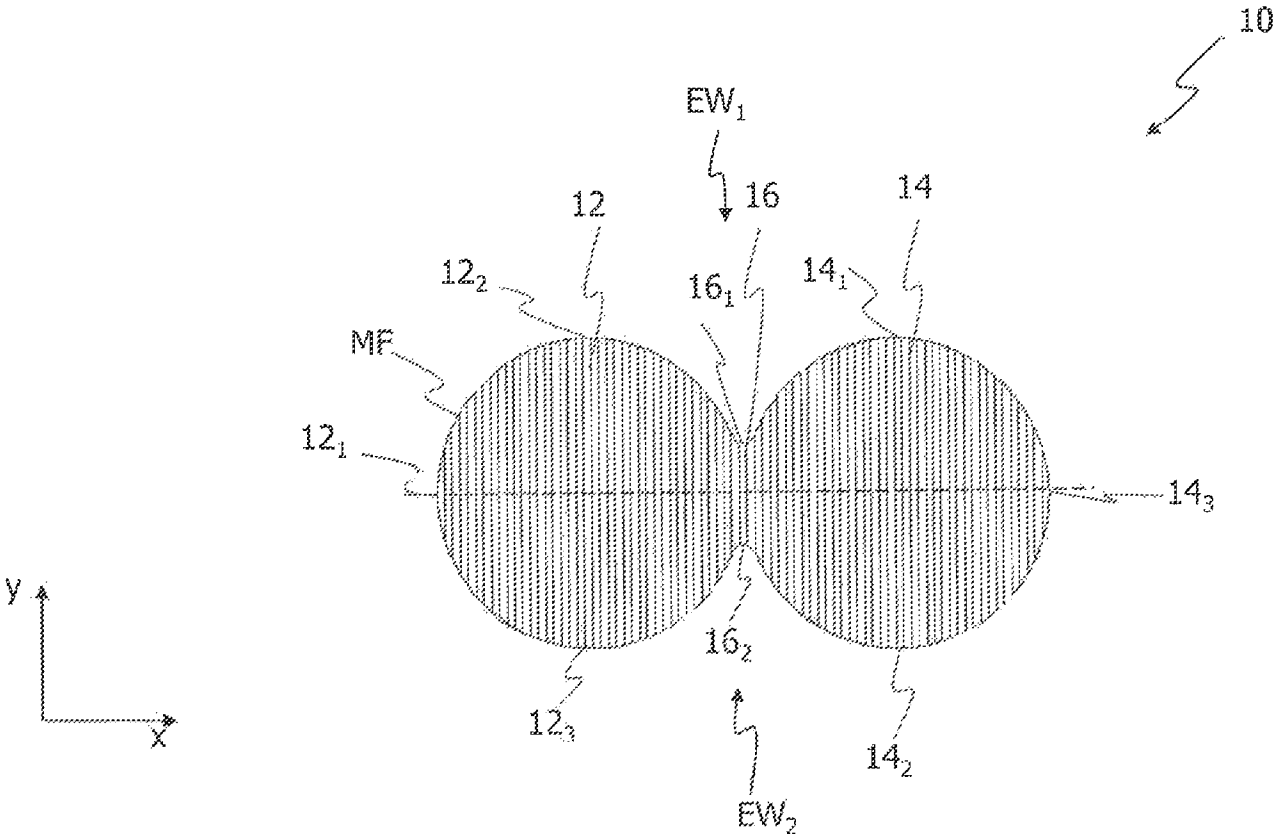
FIG. 1 is a cross-sectional view of a wire.

FIG. 1 is a cross-sectional view of a wire 10. The wire 10 has a first portion 12, a second portion 14 and a third portion 16. The third portion 16 connects the first portion 12 and the second portion 14. In the third portion 16, the wire has a reduced cross-section. The first portion 12 and the second portion 14 have a larger cross-section compared with the third portion 16. The first portion 12 and the second portion 14, when viewed in cross-section, are substantially round.

The third portion 16 extends in the form of a connecting web between the first portion 12 and the second portion 14.

The wire 10 has a curved shell surface MF. The shell surface MF is curved in the third portion 16 in the opposite direction to its curve in the first portion 12 and in the second portion 14. The shell surface MF is curved concavely in part in the third portion 16. In the first portion 12 and in the second portion 14, the shell surface MF is curved convexly in part.

When viewed in an xy-coordinate system, the cross-section of the wire 10 changes along its extent in the x-direction. Starting from the starting point $\mathbf{12}_1$ on the shell surface MF of the wire 10, the cross-section of the wire 10 increases, curved in the y-direction, to the apexes $\mathbf{12}_2$ and $\mathbf{12}_3$. Between the apexes $\mathbf{12}_2$ and $\mathbf{12}_3$, the first portion 12 of the wire 10 has its largest cross-section, or its greatest extent in the y-direction. Starting from the apexes $\mathbf{12}_2$ and $\mathbf{12}_3$, the cross-section of the wire 10 in the first portion 12 decreases, curved in the direction towards the third portion 16. In the third portion 16, the wire 10 has its smallest cross-section in the y-direction. Since the shell surface MF of the wire 10 also extends in a curved manner in the third portion 16, the wire 10 has its smallest cross-section in the y-direction in the third portion 16 between the apexes $\mathbf{16}_1$ and $\mathbf{16}_2$. Starting from the apexes $\mathbf{16}_1$ and $\mathbf{16}_2$, the cross-section of the wire 10 increases in the second portion 14 again in a curved manner to the apexes $\mathbf{14}_1$ and $\mathbf{14}_2$ of the curve of the second portion 14. Between the apexes $\mathbf{14}_1$ and $\mathbf{14}_2$ of the curve of the shell surface MF in the second portion 14, the wire 10 has its largest cross-section in the y-direction in the second portion 14. Starting with the apexes $\mathbf{14}_1$ and $\mathbf{14}_2$, the cross-section of the wire 10 decreases in the y-direction in the third portion 14 in a curved manner to the end point $\mathbf{14}_3$.

The third portion 16 is arranged between the first portion 12 and the second portion 14. The third portion 16 lies on an imaginary straight line through the starting point $\mathbf{12}_1$ and the end point $\mathbf{14}_3$, which is shown as a broken line in FIG. 1.

The above description of the cross-section of the wire 10 can be summarized as follows. Between the apexes $\mathbf{12}_2$, $\mathbf{12}_3$ and $\mathbf{14}_1$, $\mathbf{14}_2$ of the curves of the shell surface MF in portions 12 and 14, the wire 10 in each case has an indentation $EW_1$ and $EW_2$, which reduce the cross-section of the wire 10 in the third portion 16. The indentations $EW_1$ and $EW_2$ extend towards one another in the y-direction and reduce the cross-section of the wire 10 in the third portion 16. As a result, the wire 10 has its smallest cross-section in the y-direction in the third portion 16.

Figure 2:
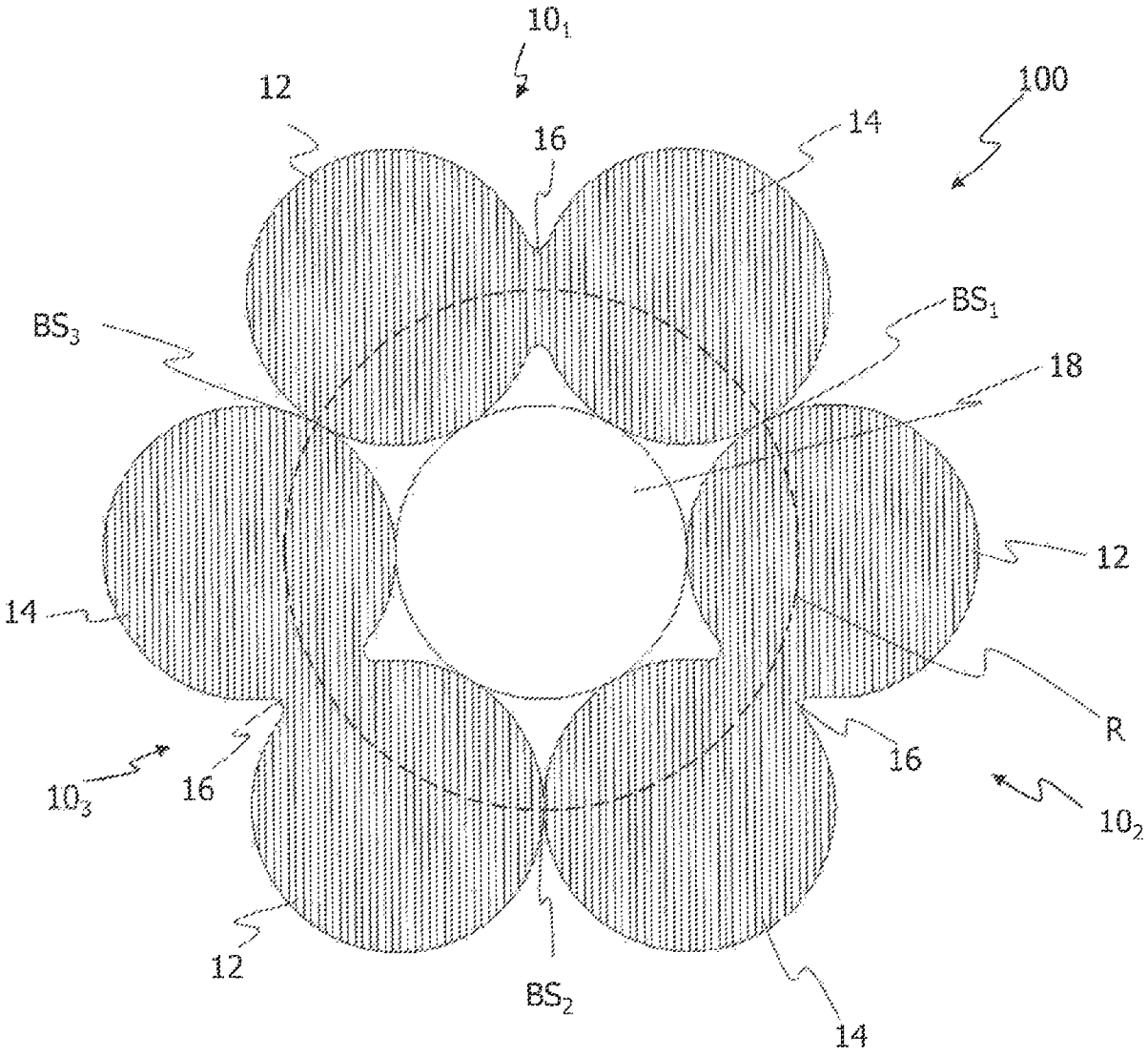
FIGS. 2 to 18 are views of different exemplary embodiments of a stranded wire with a round cross-section.

FIG. 2 shows a stranded wire 100. The stranded wire 100 has three of the wires shown in FIG. 1, which are denoted $\mathbf{10}_1$, $\mathbf{10}_2$ and $\mathbf{10}_3$. The stranded wire 100 has an inlay element 18, which forms the midpoint of the stranded wire 100. The inlay element 18 has a round cross-section. The wires $\mathbf{10}_1$, $\mathbf{10}_2$ and $\mathbf{10}_3$ are arranged around the inlay element 18 and each lie with their first portion 12 and their second portion 14 against the inlay element 18 in places. The wires $\mathbf{10}_1$, $\mathbf{10}_2$ and $\mathbf{10}_3$ lie on a radius R around the midpoint of the stranded wire 100, that is to say on a radius R around the inlay element 18.

The wires $\mathbf{10}_1$, $\mathbf{10}_2$ and $\mathbf{10}_3$ touch one another at the points of contact $BS_1$, $BS_2$ and $BS_3$. The second portion 14 of the wire $\mathbf{10}_1$ lies against the first portion 12 of the second wire $\mathbf{10}_2$ at the point of contact $BS_1$. The second portion 14 of the wire $\mathbf{10}_2$ touches the first portion 12 of the wire $\mathbf{10}_3$ at the point of contact $BS_2$. The second portion 14 of the wire $\mathbf{10}_3$ contacts the first portion 12 of the wire $\mathbf{10}_1$ at the point of contact $BS_3$. The points of contact $BS_1$, $BS_2$ and $BS_3$ between the wires $\mathbf{10}_1$, $\mathbf{10}_2$ and $\mathbf{10}_3$ lie on the radius R around the inlay element 18 which forms the midpoint of the stranded wire 100.

In the following, for reasons of clarity, only some points of contact are marked in the figures. For figures in which radii are depicted, it is to be assumed that points of contact lie on those radii, even if the points of contact are not shown in the corresponding figures.

Figure 3:
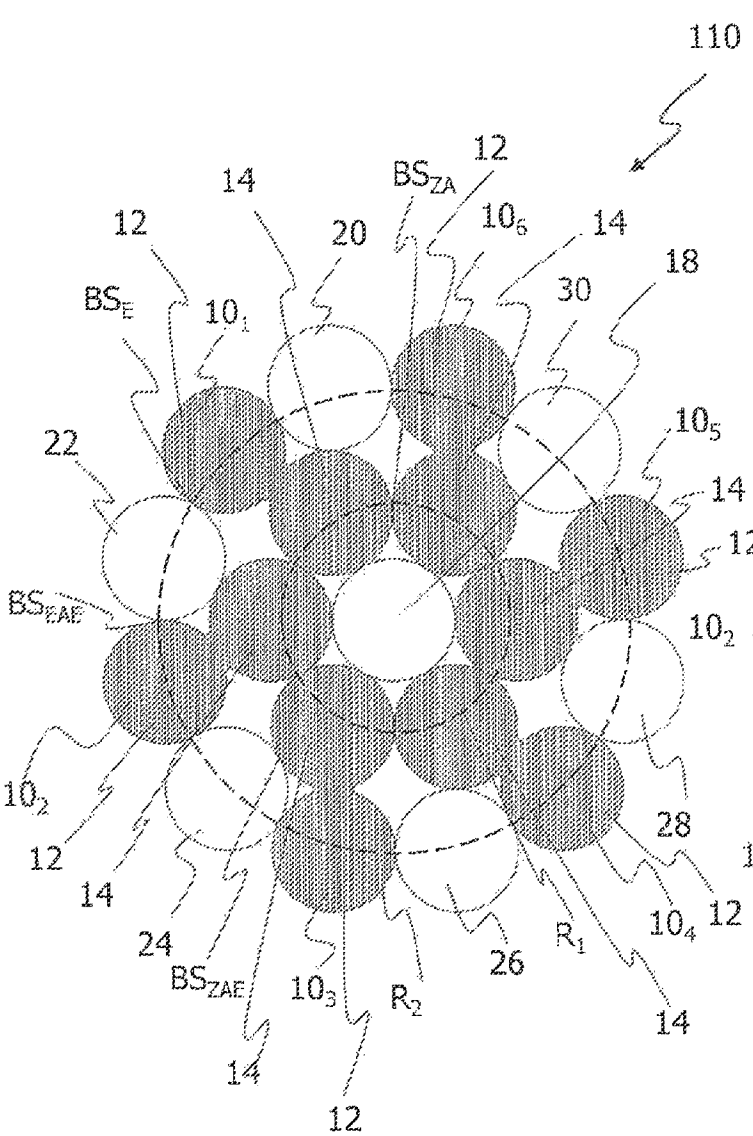

FIG. 3 shows a stranded wire 110. The stranded wire 110 has multiple inlay elements 18, 20, 22, 24, 26, 28, 30. The stranded wire 110 has six wires $\mathbf{10}_1$ to $\mathbf{10}_6$. The inlay element 18 forms the midpoint or center of the stranded wire 110. The second portions 14 of the wires $\mathbf{10}_1$ to $\mathbf{10}_6$ lie against the inlay element 18. The second portions 14 of the wires $\mathbf{10}_1$ to $\mathbf{10}_6$ lie on a first radius $R_1$ around the inlay element 18. The second portions 14 of the wires $\mathbf{10}_1$ to $\mathbf{10}_6$ touch one another at the points of contact $BS_{ZA}$. The first radius $\mathbf{12}_1$ runs through the points of contact $BS_{ZA}$. For reasons of clarity, only one of the points of contact $BS_{ZA}$ between the second portions 14 of the wires $\mathbf{10}_1$ to $\mathbf{10}_6$ is shown in FIG. 3.

The wires $\mathbf{10}_1$ to $\mathbf{10}_6$ extend obliquely radially outwards, starting from the inlay element 18. One of the inlay elements 20, 22, 24, 26, 28, 30 is arranged between two first portions 12 of two adjacent wires $\mathbf{10}_1$ to $\mathbf{10}_6$. The first portions 12 of the wires $\mathbf{10}_1$ to $\mathbf{10}_6$ and the inlay elements 20, 22, 24, 26, 28, 30 lie on a common second radius $R_2$ around the inlay element 18. The first portions 12 of the wires $\mathbf{10}_1$ to $\mathbf{10}_6$ touch the inlay elements 20, 22, 24, 26, 28, 30 at points of contact $BS_{EAE}$. The points of contact $BS_{EAE}$ lie on the second radius $R_2$. The inlay elements 20, 22, 24, 26, 28, 30 each also touch a second portion 14 of one of the wires $\mathbf{10}_1$ to $\mathbf{10}_6$ at a point of contact $BS_{ZAE}$. The inlay elements 20, 22, 24, 26, 28, 30 accordingly contribute to enabling the wires $\mathbf{10}_1$ to $\mathbf{10}_6$ in the stranded wire 110 to be arranged and held in a predetermined position and/or location.

Figure 4:
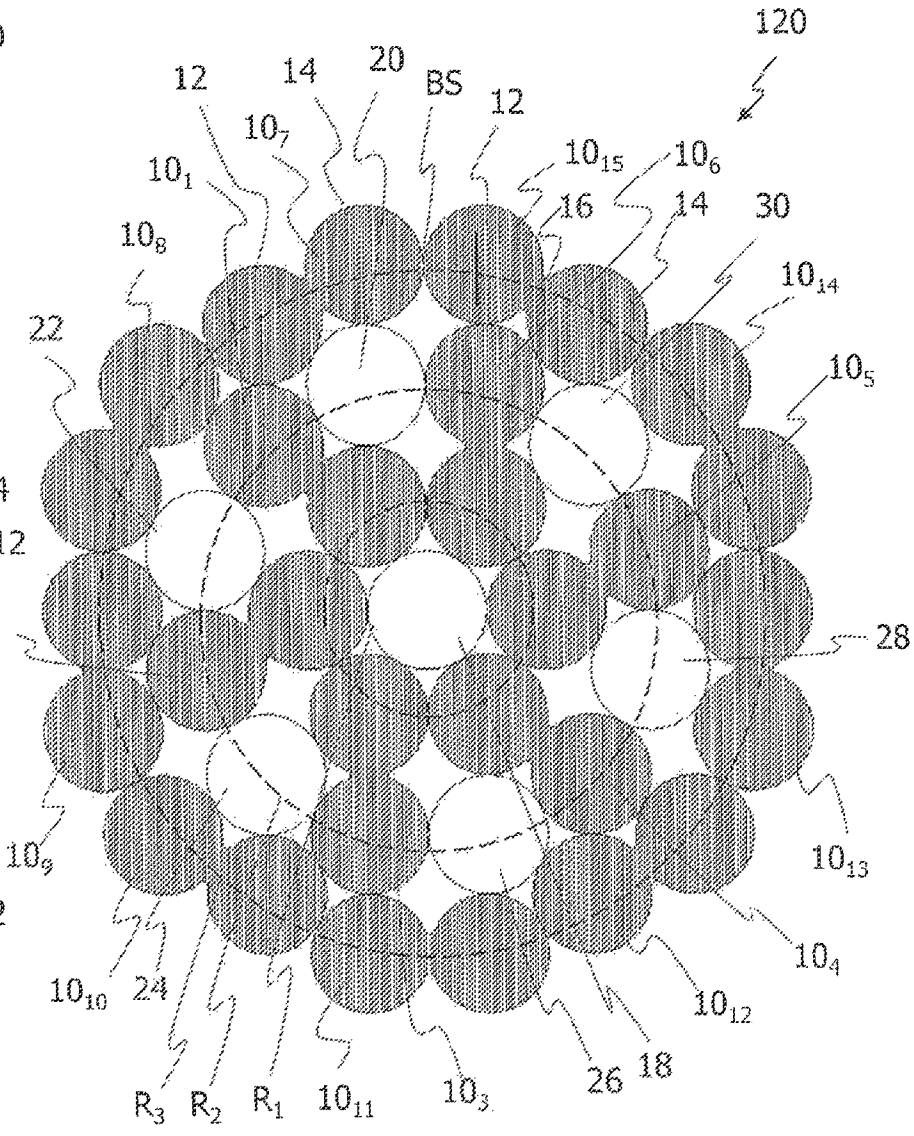

FIG. 4 shows a stranded wire 120. The structure of the stranded wire 120 largely corresponds to the structure of the stranded wire 110 which was described hereinbefore with reference to FIG. 3. In addition to the wires $\mathbf{10}_1$ to $\mathbf{10}_6$ and the inlay elements 20, 22, 24, 26, 28, 30, further wires $\mathbf{10}_7$ to $\mathbf{10}_{15}$ are arranged. The wires $\mathbf{10}_7$ to $\mathbf{10}_{15}$ are arranged on a third radius $R_3$ around the inlay element 18. The wires $\mathbf{10}_7$ to $\mathbf{10}_{15}$ extend with their portions 12, 14, 16 on the third radius $R_3$. The third radius $R_3$ extends through the points of contact BS between a second portion of the wires $\mathbf{10}_7$ to $\mathbf{10}_{15}$ and a first portion 12 of one of the wires $\mathbf{10}_7$ to $\mathbf{10}_{15}$. The point of contact BS is shown by way of example between the second portion 14 of the wire $\mathbf{10}_7$ and the first portion 12 of the wire $\mathbf{10}_{15}$.

Figure 5:
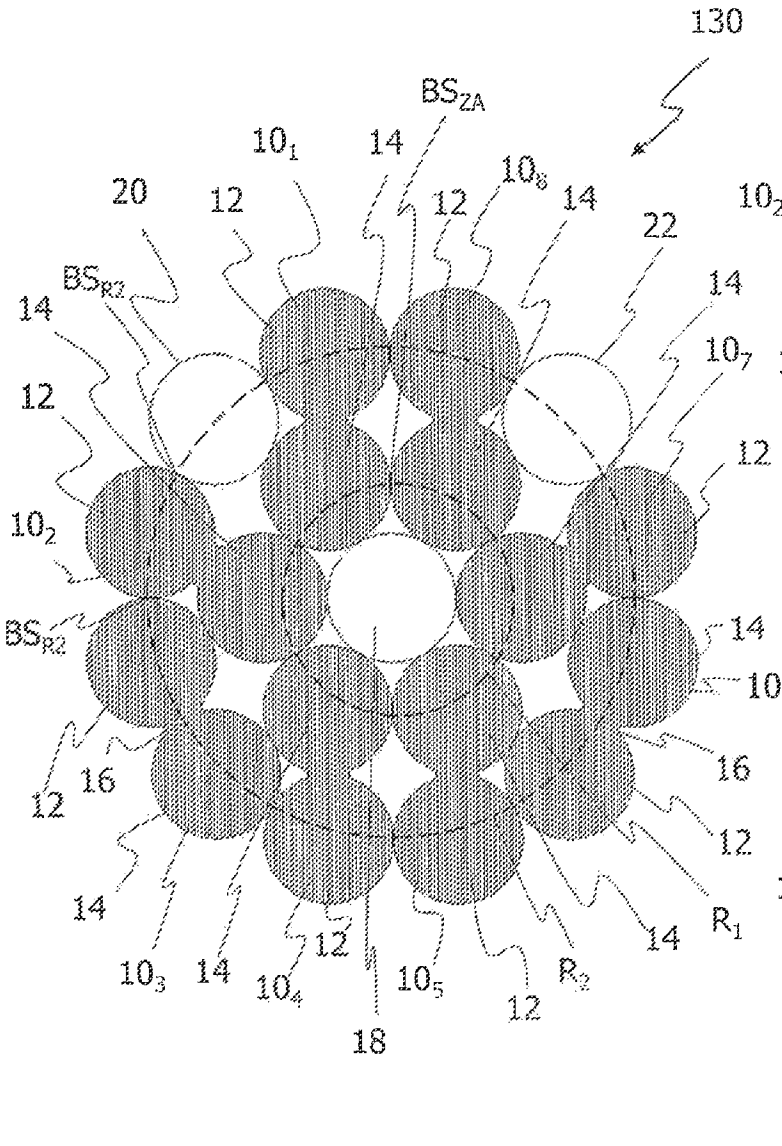

FIG. 5 shows a stranded wire 130. The stranded wire 130 has wires $\mathbf{10}_1$ to $\mathbf{10}_8$. The stranded wire 130 further comprises inlay elements 18, 20, 22. The inlay element 18 forms the midpoint of the stranded wire 130. The second portions 14 of the wires $\mathbf{10}_1$, $\mathbf{10}_2$, $\mathbf{10}_4$, $\mathbf{10}_5$, $\mathbf{10}_7$ and $\mathbf{10}_8$ lie against the inlay element 18. The portions 14 of the wires $\mathbf{10}_1$, $\mathbf{10}_2$, $\mathbf{10}_4$, $\mathbf{10}_5$, $\mathbf{10}_7$ and $\mathbf{10}_8$ lie on a radius $R_1$ around the inlay element 18 which forms the midpoint of the stranded wire 130. These second portions 14 touch one another at the points of contact $BS_{ZA}$, of which the point of contact $BS_{ZA}$ between the wire $\mathbf{10}_1$ and the wire $\mathbf{10}_8$ is shown in FIG. 5. The inlay elements 20 and 22, the first portions 12 of the wires $\mathbf{10}_1$, $\mathbf{10}_2$, $\mathbf{10}_4$, $\mathbf{10}_5$, $\mathbf{10}_7$ and $\mathbf{10}_8$, and the wires $\mathbf{10}_3$ and $\mathbf{10}_6$ with their portions 12, 14 and 16 lie on a second radius $R_2$. The radii $R_1$ and $R_2$ represent different radii around the midpoint of the stranded wire 130.

The inlay element 20 is arranged between the wires $\mathbf{10}_1$ and $\mathbf{10}_2$. The inlay element 22 is arranged between the wires $10_7$ and $10_8$. The inlay elements 20 and 22 are arranged only in a part-region of the cross-section of the stranded wire 130. The stranded wire 130 has an irregular structure. The wires $10_3$ and $10_6$, which extend with their portions 12, 14 and 16 on the radius $R_2$, are arranged between the wires $10_2$ and $10_4$ and $10_5$ and $10_7$, respectively. The mentioned elements touch one another at the points of contact $BS_{R2}$. The radius $R_2$ runs through the points of contact $BS_{R2}$.

Figure 6:
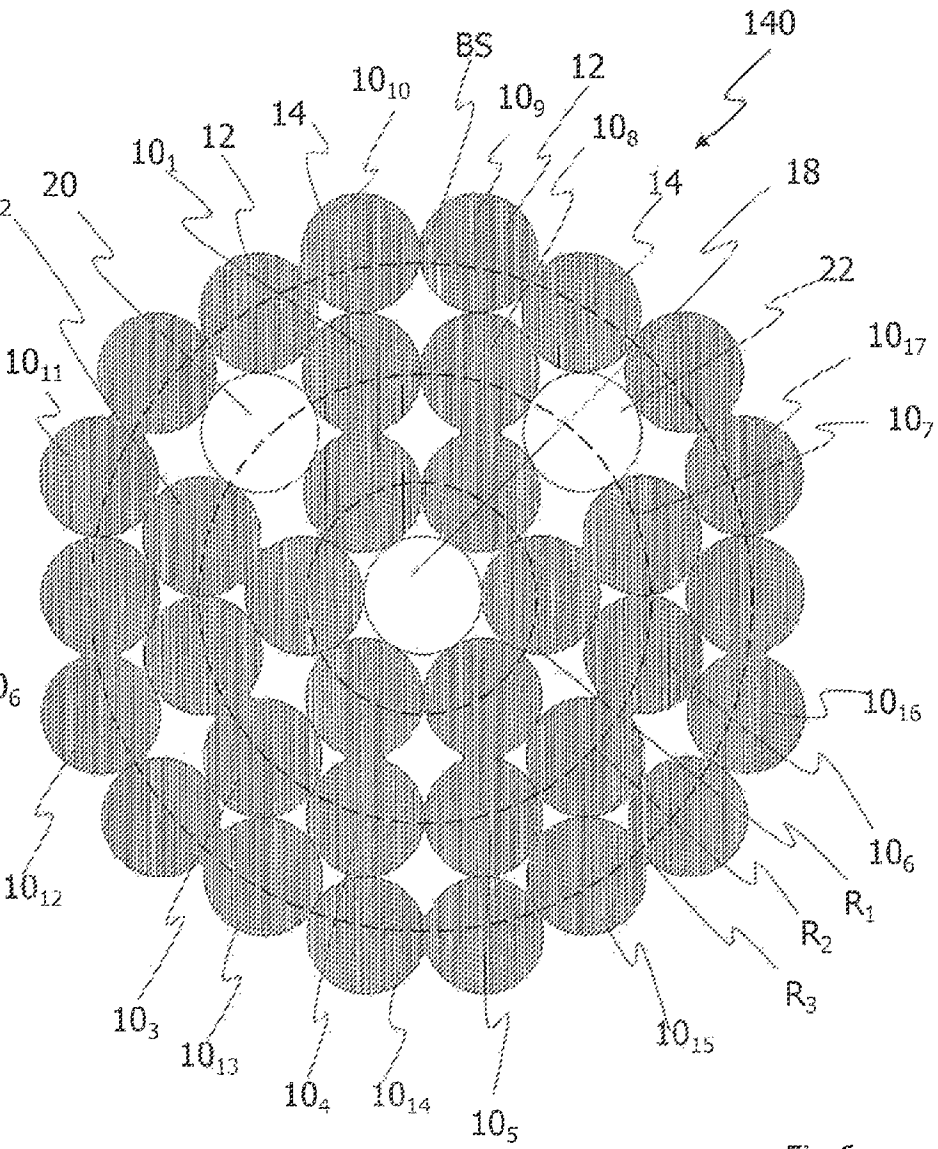

FIG. 6 shows a further exemplary embodiment of a stranded wire 140. The structure of the stranded wire 140 largely corresponds to the structure of the stranded wire 130 according to FIG. 5. Compared with the stranded wire 130 according to FIG. 5, the stranded wire 140 in FIG. 6 has additional wires $10_9$ to $10_{17}$ which are arranged with their first portions 12, second portions 14 and third portions 16 on a radius $R_3$. The wires $10_9$ to $10_{17}$ touch one another at the points of contact BS. In each case a first portion 12 of one of the wires $10_9$ to $10_{17}$ touches a second portion 14 of one of the wires $10_9$ to $10_{17}$ at the point of contact BS. The radius $R_3$ extends through the points of contact BS.

Figure 7:
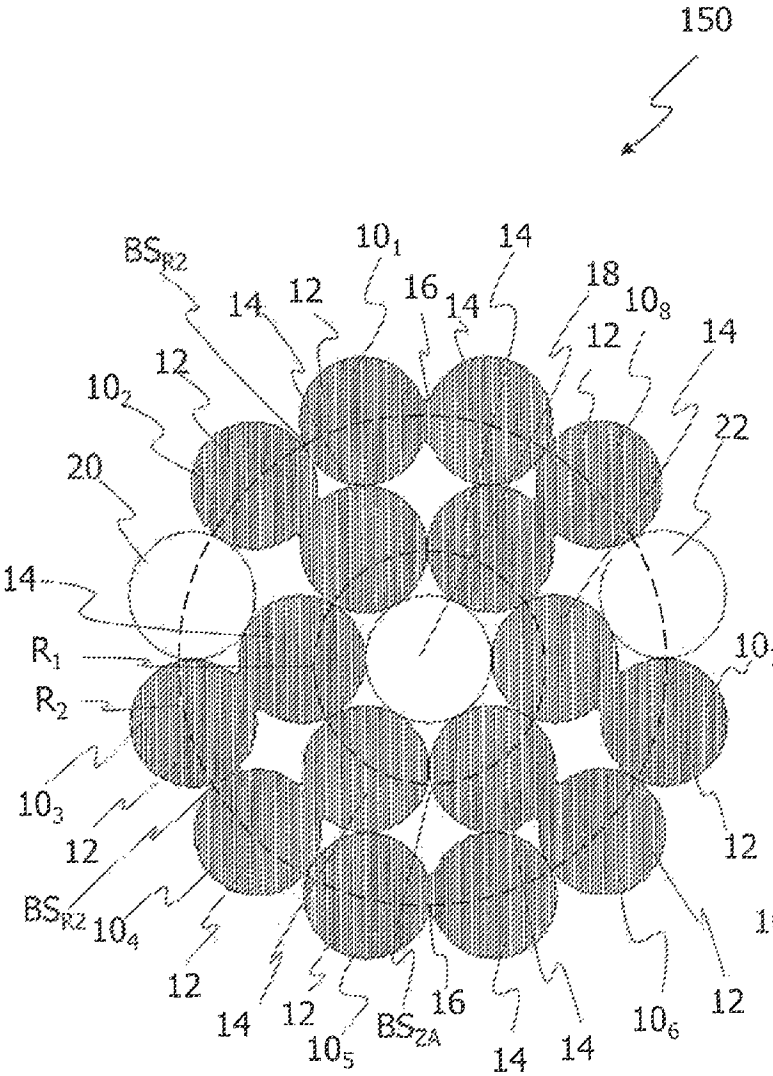

FIG. 7 shows a stranded wire 150 in cross-section. The stranded wire 150 has wires $10_1$ to $10_8$. The wires $10_2$, $10_3$, $10_4$, $10_6$, $10_7$ and $10_8$ lie with their second portions 14 against an inlay element 18 which forms the center of the stranded wire 150. The second portions 14 of the wires $10_2$, $10_3$, $10_4$, $10_6$, $10_7$ and $10_8$ lie on a radius $R_1$. The second portions 14 of the mentioned wires touch one another at the points of contact $BS_{ZA}$. The inlay elements 20 and 22, the first portions 12 of the wires $10_2$, $10_3$, $10_4$, $10_6$, $10_7$ and $10_8$ as well as the wires $10_1$ and $10_5$ with their portions 12, 14 and 16 lie on a second radius $R_2$. The wire $10_1$ is arranged between the wires $10_2$ and $10_8$. The first portion 12 of the wire $10_1$ touches the first portion 12 and the second portion 14 of the wire $10_2$. The second portion 14 of the wire $10_1$ touches the first portion 12 and the second portion 14 of the wire $10_8$. The point of contact $BS_{R2}$ between the first portions 12 of the wires $10_1$ and $10_2$ and the point of contact between the second portion 14 of the wire $10_1$ and the first portion 12 of the wire $10_8$ lie on the second radius $R_2$. The above statements apply analogously also to the wire $10_5$, which is arranged in the same way as the wire $10_1$ but extends between the wires $10_4$ and $10_6$. The wires $10_1$ and $10_2$ lie with their two portions 12, s 14 and 16 on the second radius $R_2$.

The wires $10_3$ and $10_4$ extend substantially parallel to one another and in a radial direction. The same is true of the wires $10_6$ and $10_7$. The first portions 12 of the wires $10_3$ and $10_4$ touch one another. The first portions 12 of the wires $10_6$ and $10_7$ also touch one another. The points of contact $BS_{R2}$ of the first portions 12 of the wires $10_3$, $10_4$, $10_6$ and $10_7$ lie on a second radius $R_2$. The inlay element 20 is arranged between the wires $10_2$ and $10_3$. The inlay element 20 touches the first portion 12 of the wire $10_2$ and the first portion 12 and the second portion 14 of the wire $10_3$. The inlay element 22 is arranged between the wires $10_7$ and $10_8$ and touches the first portion 12 of the wire $10_8$ and the two portions 12 and 14 of the wire $10_7$. The points of contact $BS_{R2}$ between the inlay element 20 and 22 with the first portion 12 of the wires $10_2$, $10_3$, $10_7$ and $10_8$ lie on the second radius $R_2$.

Figure 8:
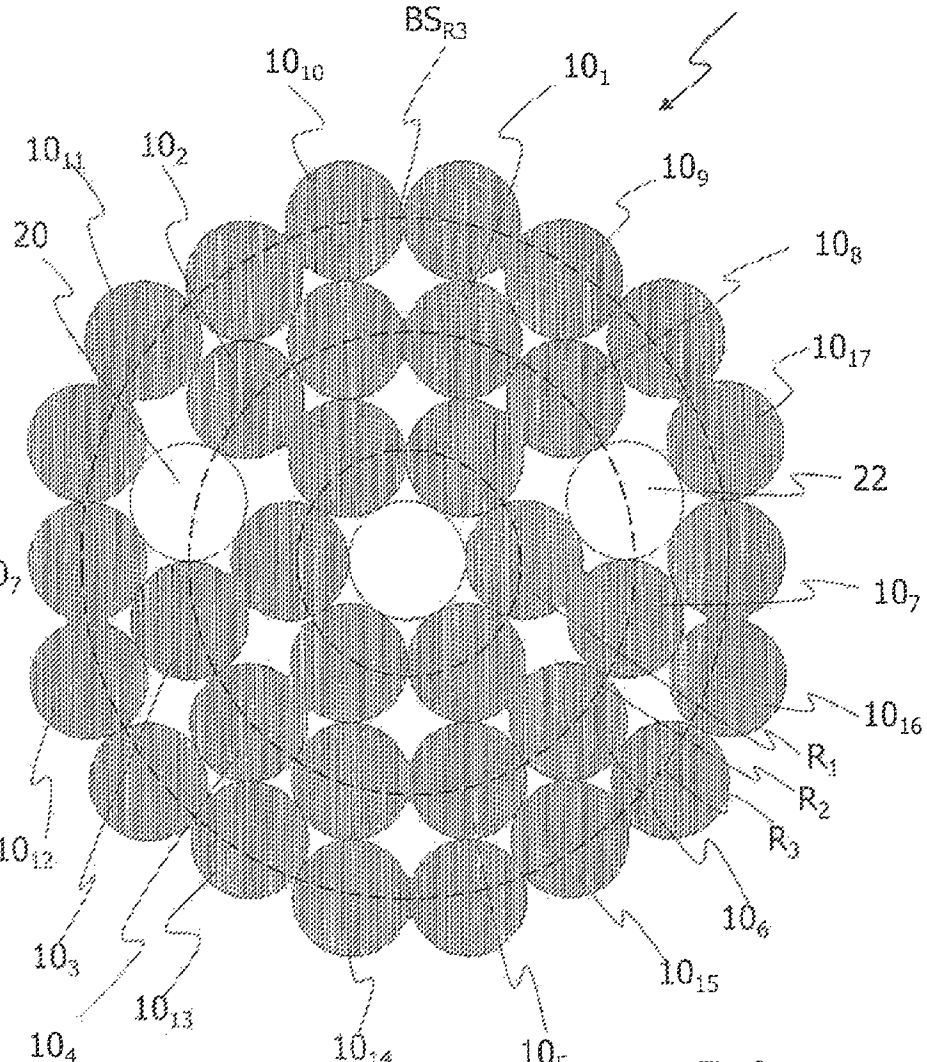

FIG. 8 shows a stranded wire 160. The structure of the stranded wire 160 corresponds to the structure of the stranded wire 150 but additionally has a layer of wires $10_9$ to $10_{17}$ which are arranged on a third radius $R_3$.

Figure 9:
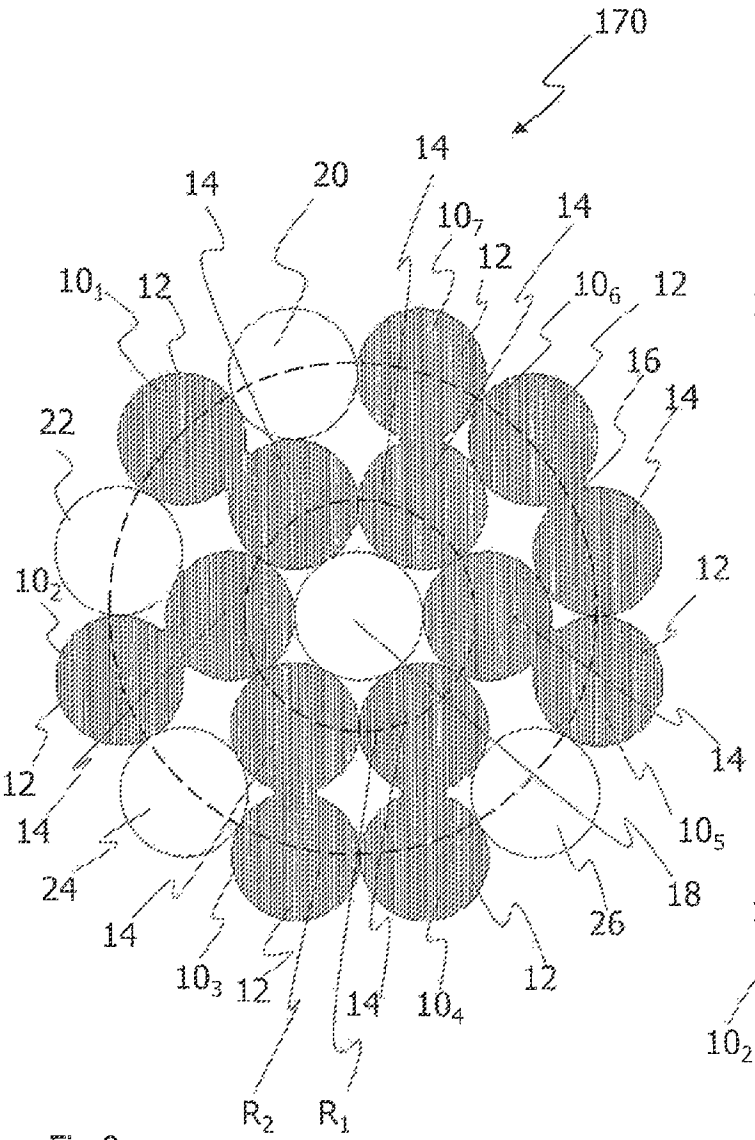

FIG. 9 shows a stranded wire 170. The stranded wire 170 has five inlay elements 18, 20, 22, 24 and 26. The inlay element 18 forms the center of the stranded wire 170. The inlay elements 20, 22, 24, 26 are arranged on the radius $R_2$. The inlay elements 20, 22, 24 are arranged between the wires $10_7$, $10_1$, $10_2$ and $10_3$. The inlay element 26 is arranged between the wires $10_4$ and $10_5$. The inlay elements 20, 22, 24, 26 touch the first portion 12 of the wires $10_7$, $10_1$, $10_2$, $10_3$, $10_4$ and $10_5$.

The wire $10_6$ extends with its portions 12, 14 and 16 on the radius $R_2$. The first portion 12 of the wire $10_6$ touches the first portion 12 and the second portion 14 of the wire $10_7$. The second portion 14 of the wire $10_6$ touches the first portion 12 and the second portion of the wire $10_5$.

The second portions 14 of the wires $10_1$, $10_2$, $10_3$, $10_4$, $10_5$ and $10_7$ touch the inlay element 18 and lie on a first radius $R_1$. The first portions 12 of the wires $10_1$ to $10_5$ and $10_7$ lie on the second radius $R_2$. The wire $10_6$ lies with its portions 12, 14 and 16 likewise on the radius $R_2$, as do the inlay elements 20, 22, 24, 26.

Figure 10:
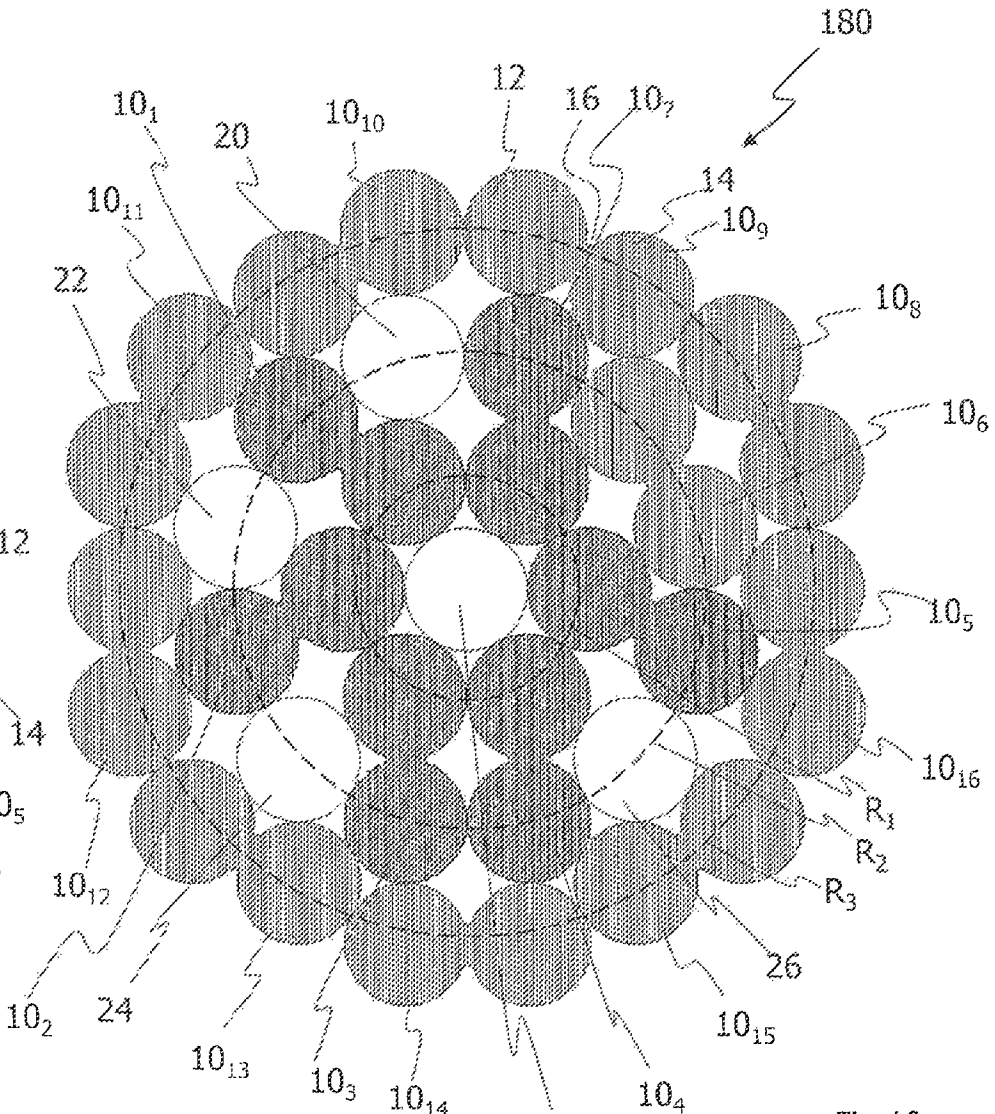

FIG. 10 shows a stranded wire 180. The stranded wire 180 corresponds substantially to the stranded wire 170 in terms of its structure. The stranded wire 180 additionally has wires $10_8$ to $10_{16}$ arranged on the radius $R_3$. Furthermore, the wires $10_1$ to $10_5$ and $10_7$ are produced from a different material than the wires $10_6$ and $10_8$ to $10_{16}$. In other words, the wire $10_6$, which lies wholly on the second radius $R_2$, and the wires $10_8$ to $10_{16}$ on the radius $R_3$ are produced from a different material than the wires $10_1$ to $10_5$ and $10_7$.

Figure 11:
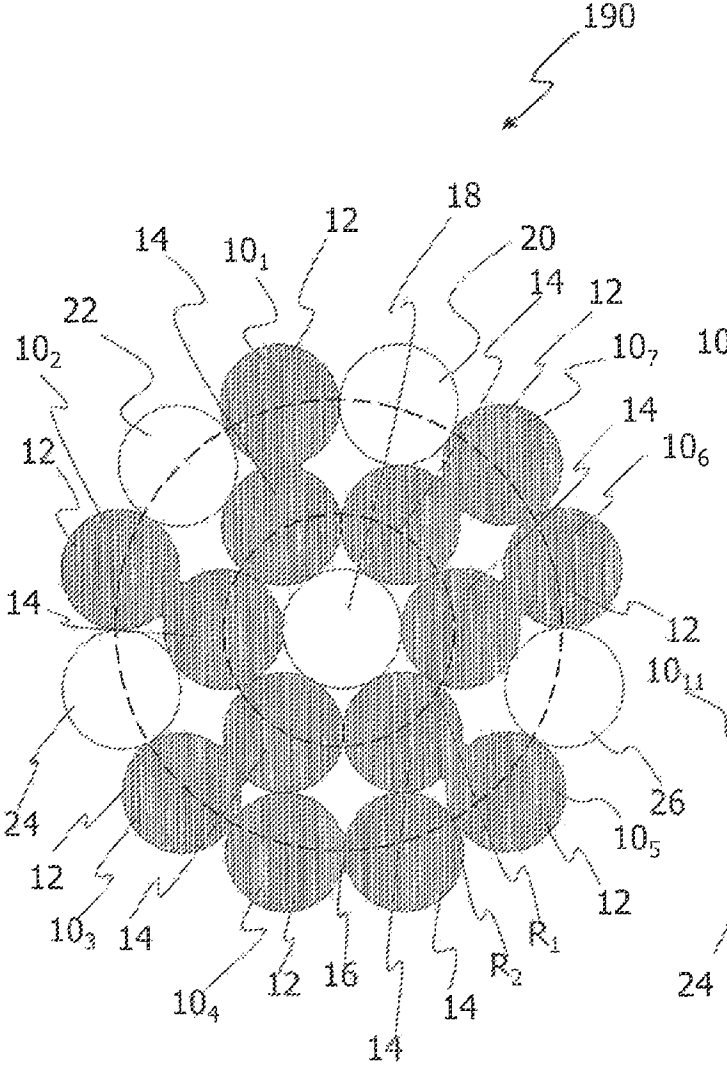

FIG. 11 shows a stranded wire 190. The stranded wire 190 has inlay elements 18, 20, 22, 24, 26. The two wires $10_6$ and $10_7$ extend substantially parallel to one another between the inlay elements 20 and 26. The inlay element 20 touches the portions 12 and 14 of the wire $10_7$ and the first portion 12 of the wire $10_1$. The inlay element 26 touches the two portions 12 and 14 of the wire $10_6$ and the first portion 12 of the wire $10_5$.

The wire $10_4$ lies with its portions 12, 14 and 16 on the second radius $R_2$. The first portion 12 of the wire $10_4$ lies against the portions 12 and 14 of the wire $10_3$. The second portion 14 of the wire $10_4$ touches the two portions 12 and 14 of the wire $10_5$. The inlay elements 20, 22, 24 are located on the second radius $R_2$ and are arranged between the wires $10_7$, $10_1$, $10_2$ and $10_3$.

Figure 12:
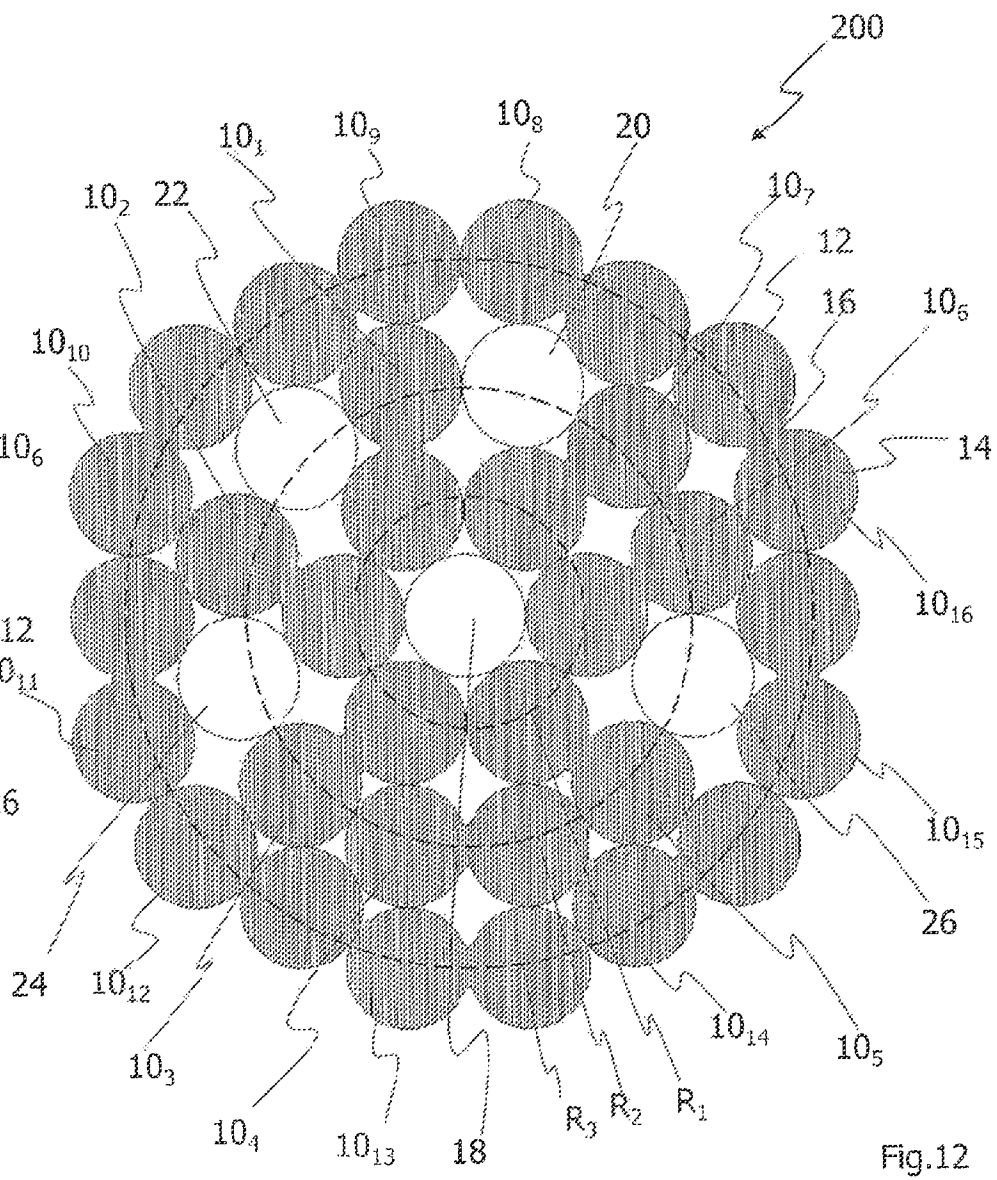

The second portions 14 of the wires $10_1$, $10_2$, $10_3$, $10_5$, $10_6$ and $10_7$ lie on the first radius $R_1$ and the second portions 14 lie on the second radius $R_2$. The portions 12 and 14 of the mentioned wires lie on the different radii $R_1$ and $R_2$.

s FIG. 12 shows a stranded wire 200. The stranded wire 200 largely corresponds to the stranded wire 190 in terms of its structure but additionally has wires $10_8$ to $10_{16}$ arranged on the third radius $R_3$. The wires $10_8$ to $10_{16}$ lie with their portions 12, 14 and 16 on the third radius $R_3$.

Figure 13:
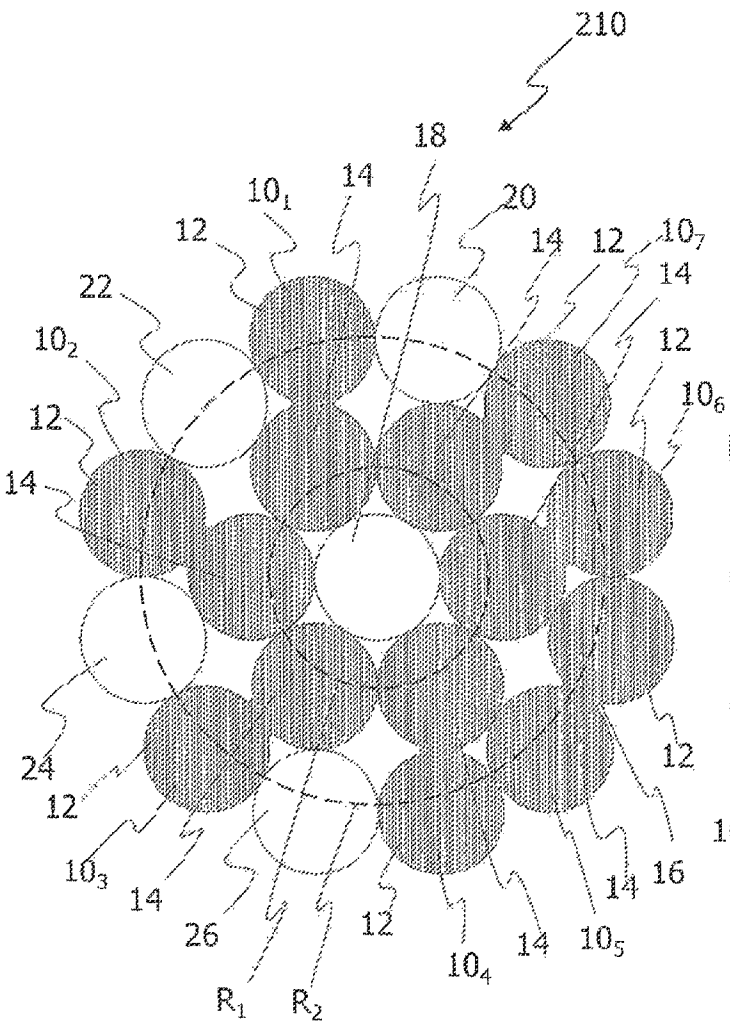

FIG. 13 shows a stranded wire 210. The stranded wire 210 has five inlay elements 18, 20, 22, 24, 26. The inlay element 18 forms the midpoint of the stranded wire 210. The wires $10_6$ and $10_7$ extend substantially parallel to one another outwards in a radial direction. The wire $10_5$ extends on the second radius $R_2$ between the wires $10_6$ and $10_4$, that is to say the portions 12, 14 and 16 of the wire $10_5$ lie on the second radius $R_2$. The inlay element 20 is arranged between the wire $10_1$ and the wire $10_7$ and touches the two first portions 12 of those wires. The inlay element 20 further touches the second portion 14 of the wire $10_7$. The inlay element 22 touches the first portion 12 and the second portion 14 of the wire $10_1$. In addition, the inlay element 22 touches the first portion 12 of the wire $10_2$. The inlay element 22 contacts the portions 12 and 14 of the wire $10_2$ and the first portion 12 of the wire $10_3$. The inlay element 26 is arranged between the wires $10_3$ and $10_4$ and touches both portions 12 and 14 of the wire $10_3$ and the first portion 12 of the wire $10_4$.

The first portions 12 of the wires $10_1$ to $10_4$ and $10_6$, $10_7$, the wire $10_5$ and the inlay elements 20, 22, 24, 26 lie on the second radius $R_2$. The second portions 14 of the wires $10_1$ to $10_4$, $10_6$ and $10_7$ touch the inlay element 18 and lie on the first radius $R_1$, which is different from the radius $R_2$.

Figure 14:
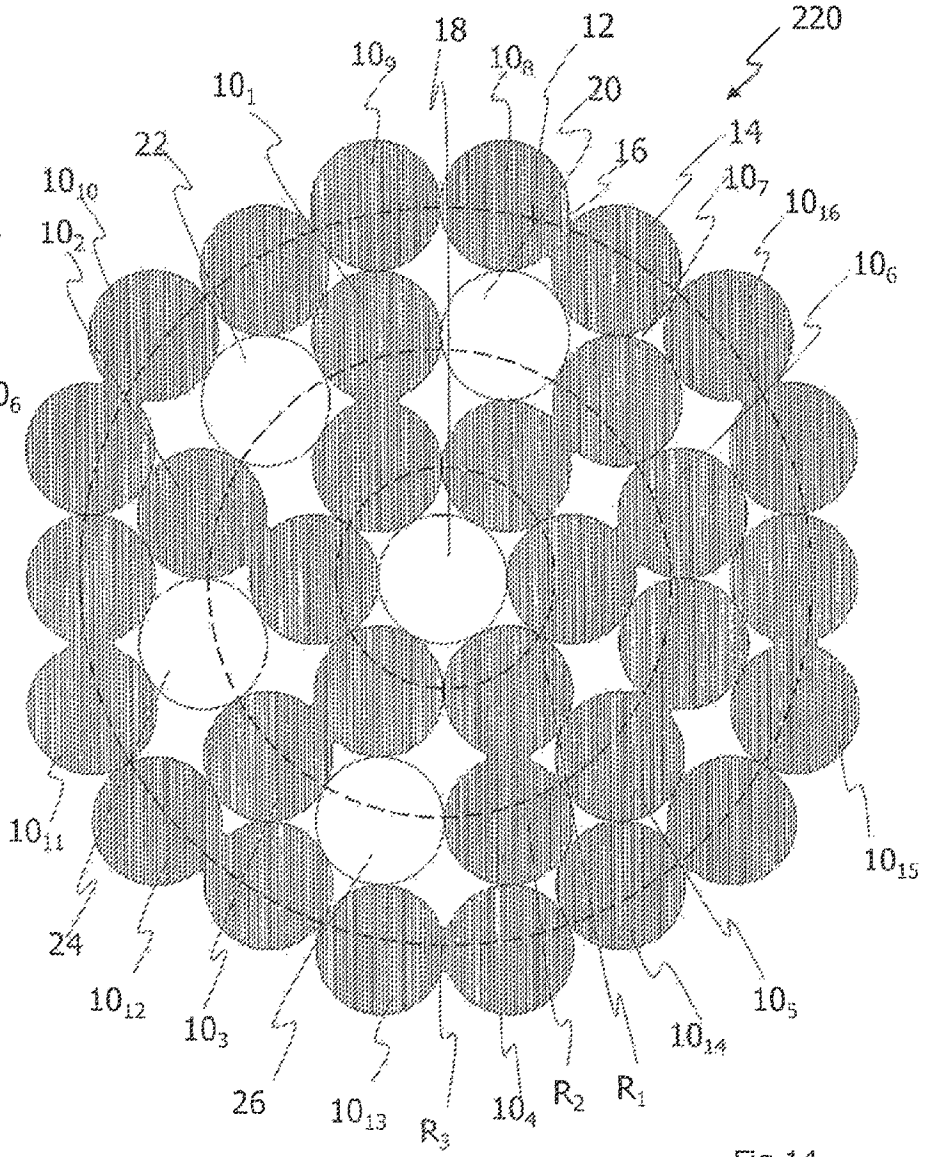

FIG. 14 shows a stranded wire 220. The inlay elements 18, 20, 22, 24, 26 and the so wires $10_1$ to $10_7$ are arranged in the same way as in the stranded wire 210 described with reference to FIG. 13. The stranded wire 220 additionally also has the wires $10_8$ to $10_{16}$, which lie with their portions 12, 14 and 16 on the third radius $R_3$, which is different from the radii $R_1$ and $R_2$.

Figure 15:
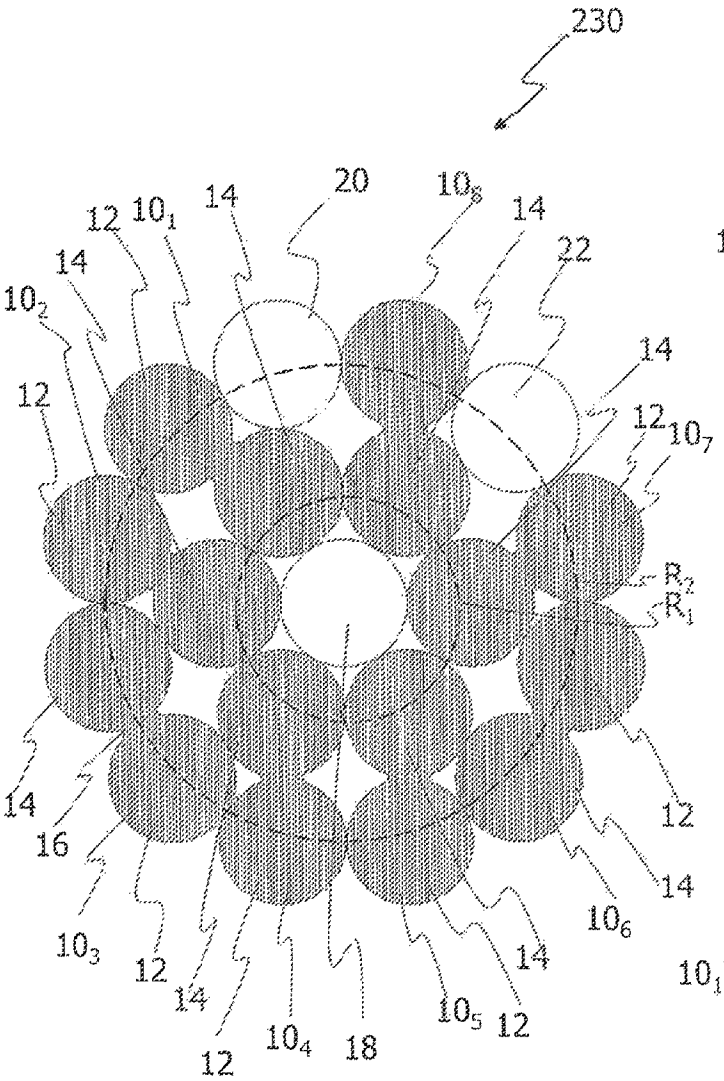

FIG. 15 shows a stranded wire 230. The stranded wire 230 has inlay elements 18, 20 and 22. The inlay element 18 forms the midpoint of the stranded wire 230. The wires $10_1$ and $10_2$ extend parallel to one another radially outwards. The same is true of the wires $10_4$ and $10_5$. The wires $10_3$ and $10_6$ lie on the second radius $R_2$ around the midpoint of the stranded wire 230, that is to say around the inlay element 18. The wire $10_3$ extends between the wires $10_2$ and $10_4$ and lies with its second portion 14 against the two portions 12 and 14 of the wire $10_2$ and with its first portion 12 against the two portions 12 and 14 of the wire $10_4$. The wire $10_6$ is arranged between the wires $10_5$ and $10_7$. The first portion 12 of the wire $10_6$ lies against the portions 12 and 14 of the wire $10_7$. The second portion 14 of the wire $10_6$ lies against the two portions 12 and 14 of the wire $10_5$. The inlay elements 20 and 22 extend between the wires $10_1$, $10_7$ and $10_8$.

Figure 16:
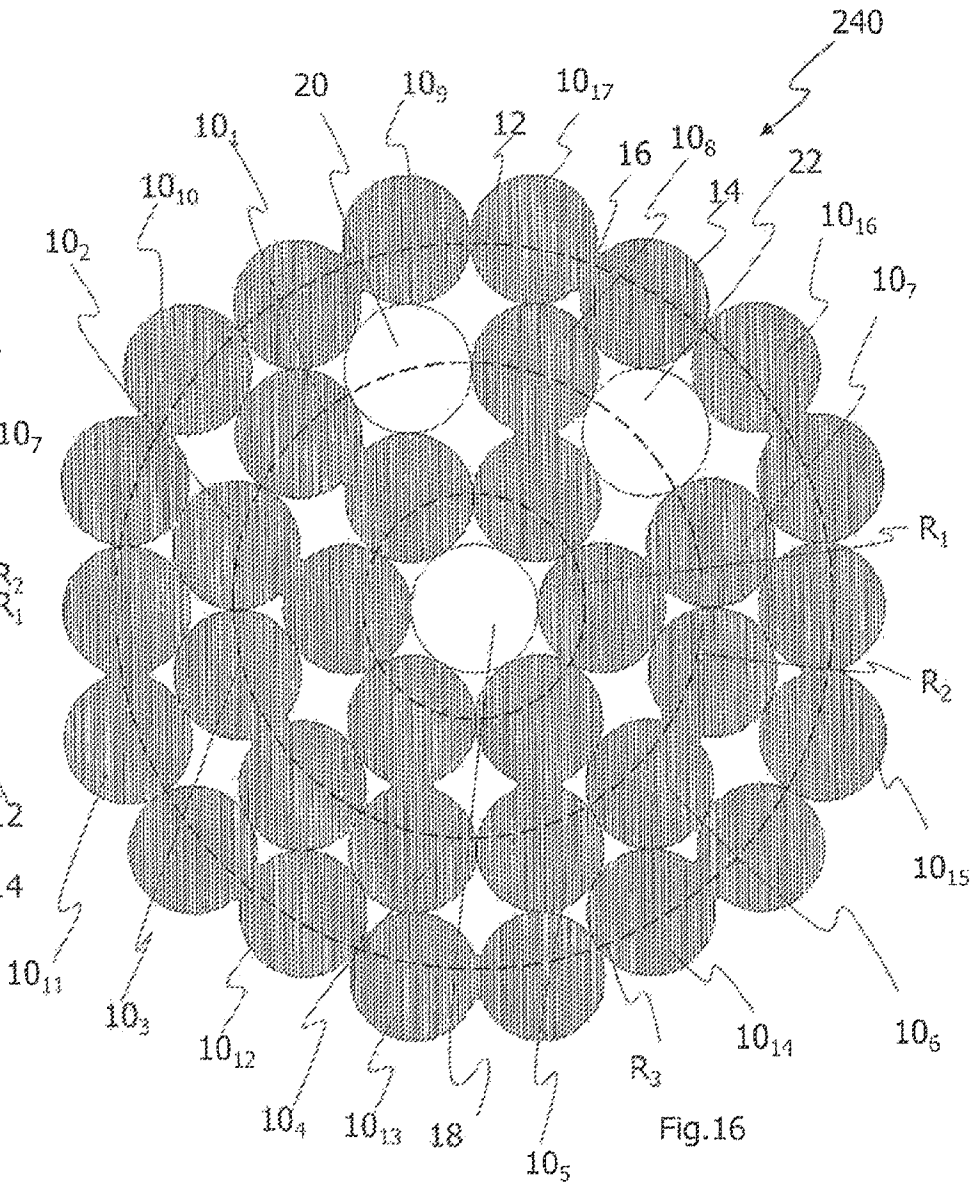

FIG. 16 shows a stranded wire 240 which differs from the stranded wire 230 by the wires $10_9$ to $10_{17}$, which are arranged on the third radius $R_3$.

Figure 17:
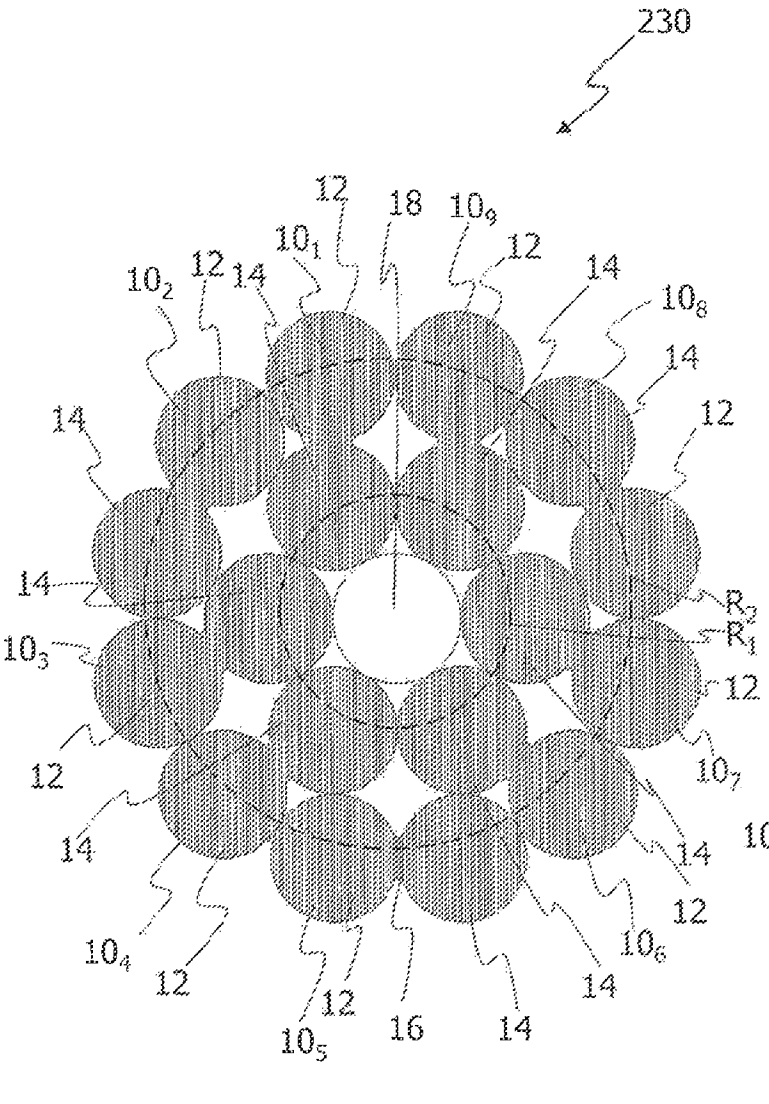

FIG. 17 shows a stranded wire 230. The stranded wire 230 has a single inlay element 18, which forms the midpoint of the stranded wire 230. The wires $10_1$, $10_3$ $10_4$, $10_6$, $10_7$ and $10_9$ extend outwards in pairs parallel to one another and in a radial direction starting from the inlay element 18. The wires $10_1$, $10_3$, $10_4$, $10_6$, $10_7$ and $10_9$ lie with their second portion 14 against the inlay element 18. The second portions 14 of the mentioned wires lie on the first radius $R_1$. The wires $10_2$, $10_5$ and $10_8$ are arranged on the second radius $R_2$. The wires $10_2$, $10_5$ and $10_8$ are arranged between the wires $10_1$, $10_9$ and $10_3$, $10_4$ and $10_6$, $10_7$ extending in pairs. The wires $10_1$ to $10_9$ are arranged in such a manner that they support one another and are thus able to maintain their predetermined position and/or location.

Figure 18:
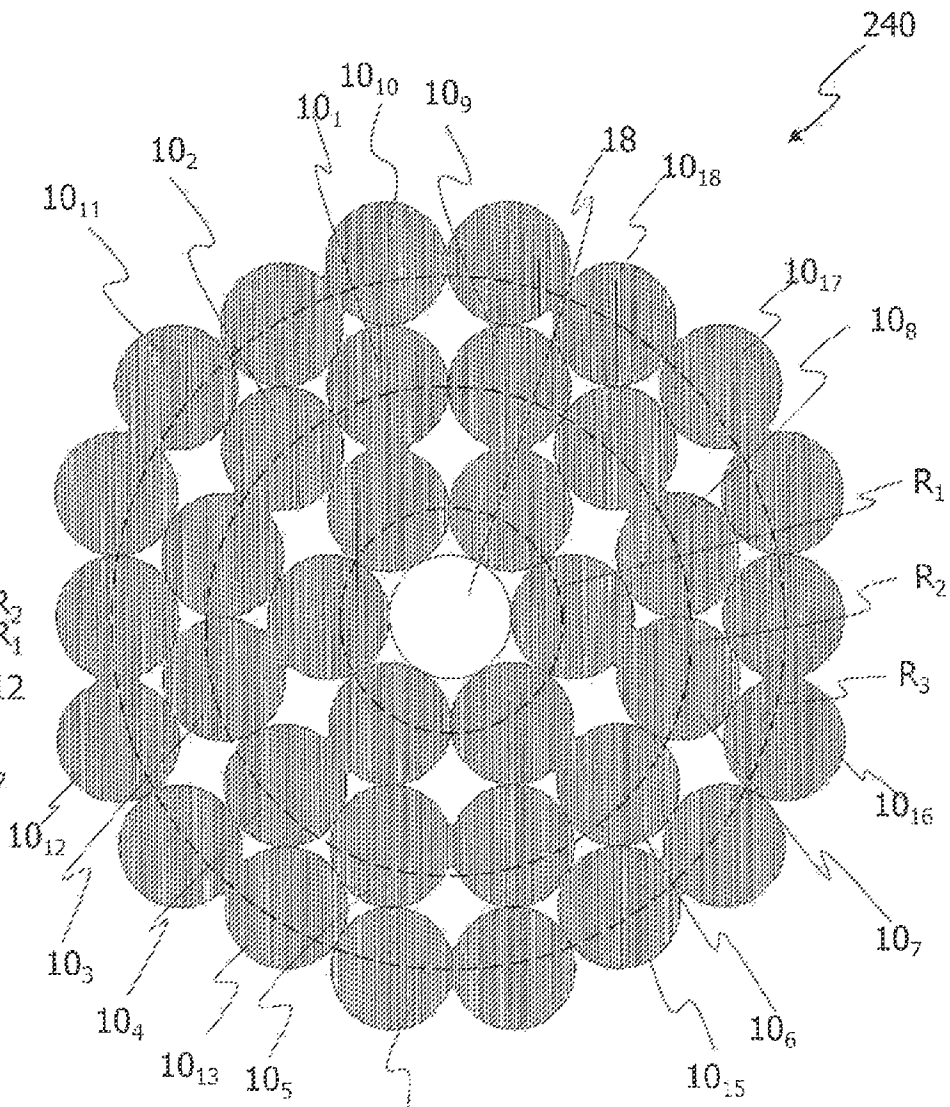

FIG. 18 shows a stranded wire 240. The stranded wire 240 is of a similar structure to the stranded wire 230. In addition to the structure of the stranded wire 230 shown in FIG. 17, the stranded wire 240 also has the wires $10_{10}$ to $10_{18}$ arranged on the third radius $R_3$.

Figure 19:
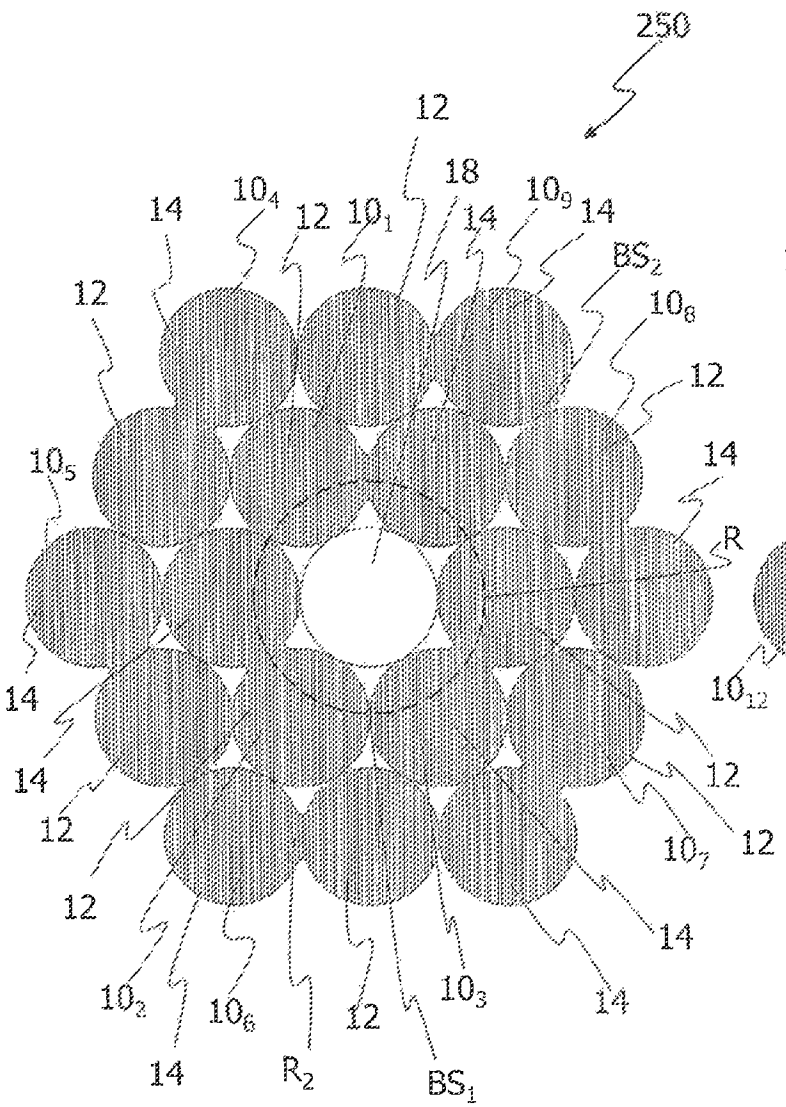

FIG. 19 shows a stranded wire 250. The stranded wire 250 has a hexagonal cross-section. The wires $10_1$ to $10_9$ are arranged against the inlay element 18 in such a manner that a hexagonal cross-section is obtained. The wires $10_1$, $10_2$ and $10_3$ lie with their two portions 12 and 14 against the shell surface of the inlay element 18 which forms the midpoint of the stranded wire 250. The wires $10_4$ to $10_9$ are arranged in such a manner that a first portion 12 of those wires in each case contacts a first portion 12 and a portion 14 of the wires $10_1$, $10_2$ and $10_3$, wherein the portions 12 and 14 do not always have to belong to a single wire $10_1$ to $10_3$.

The wires $10_1$, $10_2$ and $10_3$ which touch the inlay element 18 also touch one another at the points of contact $BS_1$. The points of contact $BS_1$ lie on a common radius R. The wires $10_4$ to $10_9$ also touch one another at the points of contact $BS_2$, wherein in each case a first portion 12 contacts a second portion 14. Owing to the hexagonal arrangement of the wires $10_4$ to $10_9$, the points of contact $BS_2$ do not lie on a common radius.

Figure 20:
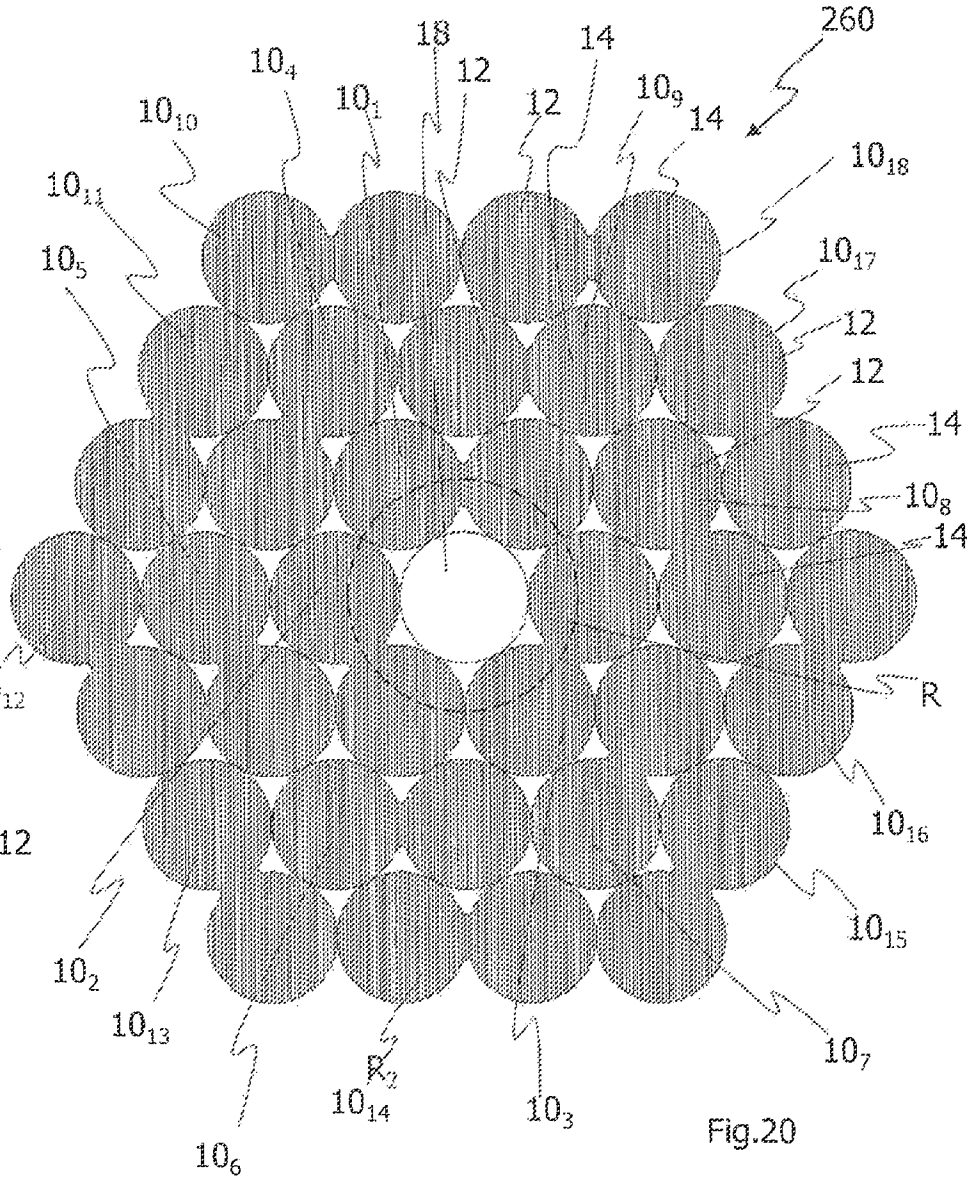
FIGS. 19 and 20 are views of an exemplary embodiment of a stranded wire with a hexagonal cross-section.

FIG. 20 is a cross-sectional view of a stranded wire 260. The stranded wire 260 has a similar structure to the stranded wire 250 which has been described with reference to FIG. 19. Compared with the stranded wire 250, the stranded wire 260 has additional wires $10_{10}$ to $10_{18}$, which are arranged along the wires $10_4$ to $10_9$. In respect of the wires $10_{10}$ to $10_{18}$, the portions 12 and 14 of each of the wires $10_{10}$ to $10_{18}$ together contact a first portion 12 or a second portion 14 of the wires $10_4$ to $10_9$, wherein the portions 12 and 14 do not always have to belong to a single wire $10_4$ to $10_9$, that is to say they can also be the first portion 12 and the second portion 14 of two wires $10_4$ to $10_9$.

Figure 21:
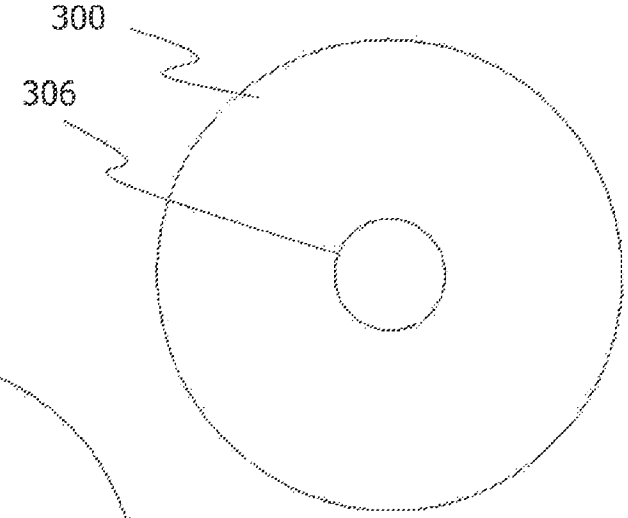
FIG. 21 shows a drawing die with a round opening.
Figure 22:
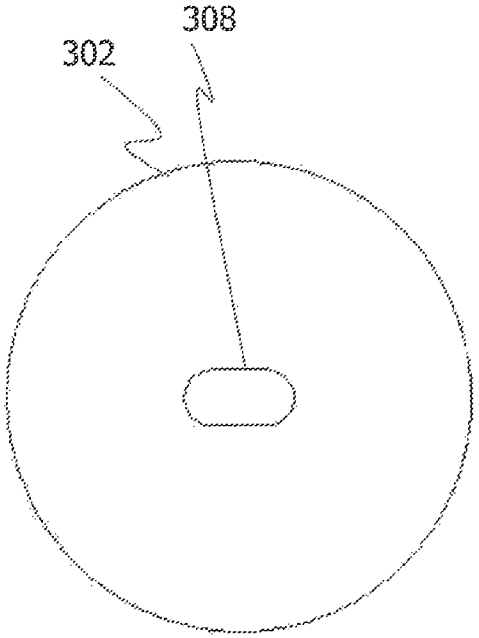
FIG. 22 shows a drawing die with an opening in the form of a slot.
Figure 23:
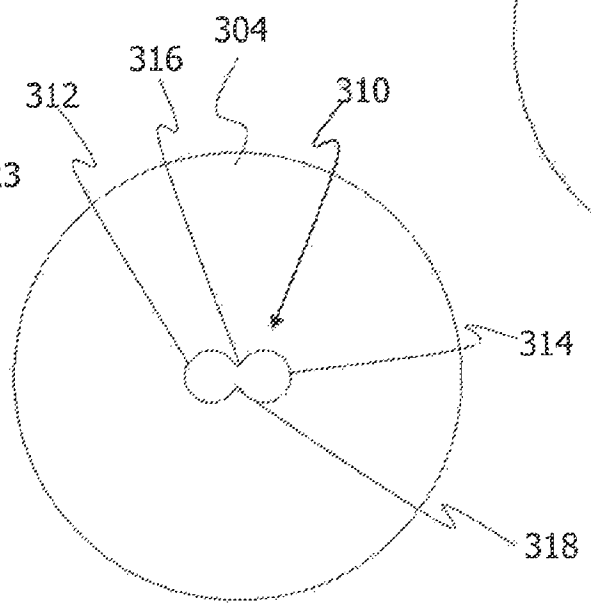
FIG. 23 shows a drawing die for producing a wire with a cross-section that is reduced in a portion.

FIGS. 21 to 23 show drawing dies 300, 302, 304 which can serve to produce the wire 10 shown in FIG. 1. The drawing die 300 has a round opening 306 in order to draw a wire into a form with a round cross-section.

The drawing die 302 according to FIG. 22 has a slot-shaped opening 308. By means of the slot-shaped opening 308, the wire acquires a cross-section that is oval in the broadest sense or also rod-shaped.

The drawing die 304 brings the wire into the shape shown in FIG. 1. For that purpose, the drawing die 304 has an opening 310. A wire having the cross-section produced by the drawing die 302, for example, can be drawn through the opening s 310 of the drawing die 304 (see FIG. 22). The opening 310 has two substantially round portions 312 and 314 which are separated from one another by two projections 316 and 318. The projections 316, 318 protrude into the opening 310 and face one another. By means of the projections 316 and 318, the cross-section of the opening 310 is reduced in that region, that it so say the cross-section of the wire in the third portion 16 (see FIG. 1) is reduced by the projections 316 and 318.

The wires 10 shown in FIG. 1 can be arranged in such a manner that they retain their predetermined position and/or location during production or during the stranding process. This means that the wires 10 are arranged in a predetermined position and/or location and are able to maintain that position and/or location during the production process. During the stranding process, all the wires 10 in a cable assembly twist, and the individual wires 10 cannot move because of their cross-section. With the wires 10 it is possible to produce a stranded wire with a round cross-section and also a circular cross-section, as is shown, for example, in FIG. 3 to 18. Owing to the round cross-sections of the stranded wire which are possible with the wire 10, insulating material can be saved, so that the production costs for a stranded wire are also reduced.

Furthermore, as is shown in FIGS. 19 and 20, stranded wires with a hexagonal cross-section can also be produced. Stranded wires with an irregular structure, which have inlay elements in only some part-regions, can also be produced with the wire 10 shown in FIG. 1, without a constricted assembly forming or the cross-section of the stranded wire becoming increasingly constricted.

With the drawing die shown in FIG. 23 it is possible to draw a wire 10 which, in a stranded wire, occupies the space of two conventional wires 10 with a round cross-section. The production time for the wire 10 can thereby be reduced and capacity at the production facility can be saved. In the case of aluminum wires, the transverse conductivity of the stranded wire is improved since no contact resistances occur between the wires 10 with the above-described cross-section.

The aspects and features which have been mentioned and described together with one or more of the examples and figures described in detail hereinbefore can further be combined with one or more of the other examples in order to replace a similar feature of the other example or in order additionally to incorporate the feature into the other example.

The description and drawings constitute only the principles of the disclosure. Furthermore, all the examples given here are expressly to serve only for teaching purposes, in order to assist the reader in understanding the principles of the disclosure and the concepts contributed by the inventor (s) to the further development of the art. All statements made herein relating to principles, aspects and examples of the disclosure and also specific exemplary embodiments thereof are to include their correspondences.

Furthermore, the following claims are hereby incorporated into the detailed description, where every claim can itself constitute a separate example. When every claim can itself constitute a separate example, it is to be noted that—although a dependent claim in the claims can relate to a specific combination with one or more other claims—other exemplary embodiments can also include a combination of the dependent claim with the subject-matter of any other dependent or independent claim. These combinations are proposed here, unless it is stated that a specific combination is not intended. Furthermore, features of a claim are also to be included for any other independent claim, even if that claim is not made directly dependent on the independent claim.

The present disclosure is of course not limited in any way to the embodiments described above. On the contrary, many possibilities for modifications thereof will be apparent to an average person skilled in the art, without departing from the underlying idea of the present disclosure as is defined in the accompanying claims.

The invention claimed is:

1. A stranded wire, comprising:

a plurality of wires, wherein each wire, when viewed in cross-section, has at least one first portion and at least one second portion which are interconnected by a third portion in which the wire has a reduced cross-section, wherein the at least one first portion, the at least one second portion, and the third portion are in one piece; and at least one inlay element which forms the midpoint of the stranded wire, wherein at least some of the wires lie with their first portion and their second portion against the at least one inlay element in places, wherein at least one wire is arranged with its first portion on a first radius and with its second portion on a second radius around the midpoint of the stranded wire, wherein the first radius and the second radius are different, and/or wherein at least one wire is arranged with its first portion and with its second portion on a radius around the midpoint of the stranded wire.

2. The wire as claimed in claim 1, wherein each wire has a curved shell surface, wherein the shell surface in the third portion is curved in the opposite direction to its curve in the first portion and/or in the second portion.

3. A stranded wire, comprising:

a plurality of wires, wherein each wire, when viewed in cross-section, has at least one first portion and at least one second portion which are interconnected by a third portion in which the wire has a reduced cross-section, wherein the at least one first portion, the at least one second portion, and the third portion are in one piece, wherein the first portion and the second portion of the wire, when viewed in cross-section, are substantially round; and at least one inlay element which forms the midpoint of the stranded wire, wherein at least some of the wires lie with their first portion and/or their second portion against the at least one inlay element in places, wherein at least one wire is arranged with its first portion on a first radius and with its second portion on a second radius around the midpoint of the stranded wire, wherein the first radius and the second radius are different, and/or wherein at least one wire is arranged with its first portion and with its second portion on a radius around the midpoint of the stranded wire.

* * * * *